US008148040B2

(12) United States Patent
Yamamoto et al.

(10) Patent No.: US 8,148,040 B2
(45) Date of Patent: Apr. 3, 2012

(54) TONER AND METHOD OF MANUFACTURING THE SAME, TWO-COMPONENT DEVELOPER, DEVELOPING DEVICE, AND IMAGE FORMING APPARATUS

(75) Inventors: Yoshinori Yamamoto, Niimi (JP); Hiroshi Onda, Yamatokoriyama (JP); Saori Yamada, Nara (JP); Yoshiaki Akazawa, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 834 days.

(21) Appl. No.: 12/163,054

(22) Filed: Jun. 27, 2008

(65) Prior Publication Data

US 2009/0004590 A1 Jan. 1, 2009

(30) Foreign Application Priority Data

Jun. 28, 2007 (JP) ..... P2007-171160

(51) Int. Cl.
*G03G 9/00* (2006.01)

(52) U.S. Cl. ..... 430/110.3; 430/108.1; 430/110.4; 430/137.18

(58) Field of Classification Search ..... 430/108.1, 430/110.3, 110.4, 137.1, 137.18; 241/5
See application file for complete search history.

(56) References Cited

U.S. PATENT DOCUMENTS

| | | | | |
|---|---|---|---|---|
| 5,547,797 | A * | 8/1996 | Anno et al. | 430/110.3 |
| 5,738,962 | A | 4/1998 | Ichimura et al. | |
| 5,804,351 | A * | 9/1998 | Takano et al. | 430/110.4 |
| 2005/0139701 | A1 * | 6/2005 | Naka et al. | 241/5 |
| 2006/0068314 | A1 * | 3/2006 | Kawata | 430/110.4 |
| 2009/0053643 | A1 | 2/2009 | Kawata | |

FOREIGN PATENT DOCUMENTS

| | | | |
|---|---|---|---|
| JP | 9-114127 | A | 5/1997 |
| JP | 9-197714 | A | 7/1997 |
| JP | 2003-186235 | A | 7/2003 |
| JP | 2004-4974 | A | 1/2004 |
| JP | 2005-37857 | A | 2/2005 |
| JP | 2005-91737 | A | 4/2005 |
| JP | 2006-85042 | A | 3/2006 |
| JP | 2006-126793 | A | 5/2006 |

* cited by examiner

*Primary Examiner* — Christopher Rodee
*Assistant Examiner* — Stewart Fraser
(74) *Attorney, Agent, or Firm* — Nixon & Vanderhye P.C.

(57) ABSTRACT

In a toner at least containing a binder resin and a colorant, a value obtained by dividing a particle size $D_{50p}$ by a particle size $D_{84p}$ is 1.43 or more and 1.64 or less, wherein $D_{50p}$ and $D_{84p}$ respectively represent particle sizes at 50% and 84% of cumulative number counted from a large-size side in a cumulative number distribution. Further, in the toner, an average degree of circularity of toner particles having a volume average particle size of 1 μm or more and 4 μm or less is 0.940 or more and 0.960 or less. Further, in the toner, a content of toner particles having an average degree of circularity of 0.850 or less is 10% by number or less among the toner particles having a volume average particle size of 1 μm or more and 4 μm or less.

8 Claims, 6 Drawing Sheets

TONER AND METHOD OF MANUFACTURING THE SAME, TWO-COMPONENT DEVELOPER, DEVELOPING DEVICE, AND IMAGE FORMING APPARATUS

CROSS-REFERENCE TO RELATED APPLICATION

This application claims priority to Japanese Patent Application No. 2007-171160, which was filed on Jun. 28, 2007, the contents of which are incorporated herein by reference in its entirety.

BACKGROUND OF THE INVENTION

1. Field of the Invention

The present invention relates to a toner, a method of manufacturing the same, a two-component developer, a developing device, and an image forming apparatus.

2. Description of the Related Art

Electrophotographic image forming apparatuses have been widely used as copiers so far, and in recent days, also as printers, facsimile machines, and the like apparatuses along with spread of computers since the electrophotographic image forming apparatuses operate excellently as output units for computer images created by computers. In a general electrophotographic image forming apparatus, a desired image is formed on a recording medium through a charging step of uniformly charging a photosensitive layer of a photoreceptor drum; an exposing step of irradiating signal light of an original image onto the surface of the charged photoreceptor drum so that an electrostatic latent image is formed thereon; a developing step of supplying an electrophotographic toner (hereinafter, simply referred to as "a toner") to the electrostatic latent image on the surface of the photoreceptor drum so that the electrostatic latent image is visualized and a visible image is thus formed thereon; a transferring step of transferring the visible image on the surface of the photoreceptor drum onto a recording medium such as paper or OHP sheet; a fixing step of fixing the visible image onto the recording medium by application of heat, pressure, etc.; and a cleaning step of removing and cleaning by a cleaning blade the toner and the like remaining left over the surface of the photoreceptor drum after the visible image has been transferred. The visible image may be transferred onto the recording medium by way of an intermediate transfer medium.

In the meantime, various techniques related to computers have been further developed. For example, definition of computer images becomes higher and higher. This raises a demand on the electrophotographic image forming apparatus to form high-definition images almost equivalent to the computer images, which high-definition images reproduce tiny shapes, slight hue variation, etc. of the computer images precisely and clearly. In response to the demand, definition of the electrostatic latent image is further improved. In order to precisely reproduce a high-definition image with the improvement in the definition of the electrostatic latent image, there has been proposed various arts for precisely controlling characteristics of a developer adhered to a recording medium, such as an average particle size, a particle size distribution and a coloring property of the toner. Among these arts, many are particularly proposed to further improve image quality by decreasing the particle size of the toner, and various studies have been made for manufacturing a small-size toner. The small-size toner is useful for forming high-definition images. However, when the small-size toner contains a large amount of fine toner particles having a volume average particle size of 4 μm or less, for example, there is caused such a problem that flowability and transfer efficiency undesirably decrease, thus resulting in a failure to obtain an image of a sufficient quality.

In order to solve this problem, in the toner and the developer composition of Japanese Unexamined Patent Publication JP-A 9-114127 (1997), a toner having a volume average particle size of 3.0 μm to 9.0 μm is so regulated that a volume average particle size, a content of a colorant, and a weight of developed toner satisfy a predetermined condition, thus achieving a good balance between high image-quality and developing property (an appropriate density and prevention of fogs). However, in this case, JP-A 9-114127 discloses that in order to obtain an image of a higher quality, particle size distribution is set to $D_{50P}/D_{84P} \leqq 1.45$.

Further, the image forming apparatus of Japanese Unexamined Patent Publication JP-A 2004-4974 is so designed as to be capable of forming a high-definition image on a recording medium, by using a color toner which is synthesized according to a polymerization method and in which the following expression is satisfied: $1.25 \leqq Dn50/Dn25 \leqq 1.50$ and a loose apparent density of the developer is set to be from 0.30 to 0.45 mg/cm$^3$. Note that Dn25 represents a size at 25% of cumulative number and Dn50 represents a size at 50% of cumulative number.

Further, a toner having an average degree of circularity of 0.940 or less, for example, generally exhibits a good cleaning property since it is easily scraped by a cleaning blade. However, in this case, a decrease occurs in the efficiency of the transferring of the toner onto the recording medium, thus causing a failure to stably form a high-definition image. On the other hand, when the toner is close to a perfect sphere in shape, the transfer efficiency is high but the toner is difficult to be scraped by the cleaning blade, thus causing deterioration in cleaning property. Consequently, a design on a shape of the toner is important for obtaining a toner which exhibits a good cleaning property and excellent transfer efficiency and which can correspond to high-definition of the image.

In JP-A 9-114127 and JP-A 2004-4974, the particle size distributions of toner are so defined as $D_{50P}/D_{84P} \leqq 1.45$, or $1.25 \leqq Dn50/Dn25 \leqq 1.50$. However, in the particle size distributions, the content of the fine toner particles having a volume average particle size of 4 μm or less is insufficient, thus causing a failure to obtain an image sufficiently improved in image definition and resolution.

Further, among the toner particles, particles having a volume average particle size of 1 μm or more and 4 μm or less exert a great influence on flowability and transfer efficiency of the toner. Therefore, it is necessary to design shapes of the toner particles having a volume average particle size of 1 μm or more and 4 μm or less, so as to obtain a toner excellent in flowability and transfer efficiency and to obtain a high-quality image sufficiently improved in definition and resolution.

SUMMARY OF THE INVENTION

An object of the invention made in view of the above problems, is to provide a toner which has a good cleaning property and exhibits high-level flowability and transfer efficiency and by using which a high-quality image of high definition and resolution can be formed, and further to provide a method of manufacturing the toner, a two-component developer, a developing device, and an image forming apparatus.

The invention provides a toner at least containing a binder resin and a colorant, particle sizes $D_{50p}$ and $D_{84P}$ satisfying the following formula (1):

$$1.43 \leqq D_{50p}/D_{84p} \leqq 1.64 \quad (1)$$

wherein $D_{50p}$ and $D_{84p}$ respectively representing particle sizes at 50% and 84% of cumulative number counted from a large-size side in a cumulative number distribution, an average degree of circularity of toner particles having a volume average particle size of 1 μm or more and 4 μm or less being 0.940 or more and 0.960 or less, and among the toner particles having a volume average particle size of 1 μm or more and 4 μm or less, a content of toner particles having an average degree of circularity of 0.850 or less being 10% by number or less.

According to the invention, in a toner at least containing a binder resin and a colorant, particle sizes $D_{50p}$ and $D_{84P}$ satisfy the above formula (1), wherein $D_{50p}$ and $D_{84p}$ respectively represent particle sizes at 50% and 84% of cumulative number counted from a large-size side in a cumulative number distribution. This allows a content of fine toner particles having a volume average particle size of 4 μm or less to fall in a preferred range. Therefore, it is possible to form a high-quality image high in definition and resolution.

Further, an average degree of circularity of toner particles having a volume average particle size of 1 μm or more and 4 μm or less is set to be 0.940 or more and 0.960 or less. By doing so, the toner particles can be preferably shaped which are 1 μm or and 4 μm or less in a volume average particle size and influential on flowability and transfer efficiency of the toner. Therefore, it is possible to cause the toner to maintain a good cleaning property and have high-level flowability and transfer efficiency.

Further, among the toner particles having a volume average particle size of 1 μm or more and 4 μm or less, a content of toner particles having an average degree of circularity of 0.850 or less is 10% by number or less. This makes it possible to restrain a content of amorphous toner low in transfer efficiency and to narrow a circularity degree distribution. Therefore, it is possible to maintain high transfer efficiency and stably form a high-quality image.

As described above, a control is performed on the particle size distribution of the toner as well as on the average degree of circularity and the circularity degree distribution of the toner particles having a volume average particle size of 1 μm or and 4 μm or less. This allows the toner to have a good cleaning property and exhibit high-level flowability and transfer efficiency. Further, by using the toner, it is possible to form a high-quality image high in definition and resolution.

Further, it is preferable that the particle sizes $D_{50p}$ and $D_{84p}$ satisfy the following formula (2):

$$1.46 \leqq D_{50p}/D_{84p} \leqq 1.64 \quad (2)$$

According to the invention, the particle sizes $D_{50p}$ and $D_{84p}$ satisfy the above formula (2). This allows the content of the fine toner particles to fall in a more preferred range. Therefore, it is possible to form a high-quality image of higher definition and resolution.

Further, it is preferable that the toner particles having a volume average particle size of 1 μm or more and 4 μm or less are contained in a ratio of 20% by number or more and 50% by number or less on the basis of the entire toner particles.

According to the invention, this allows a high resolution to be obtained and the charge amount of the toner particles to fall in a predetermined range. Therefore, the quality of a formed image can be further improved.

Further, it is preferable that an average degree of circularity of the entire toner particles is 0.955 or more and 0.975 or less.

According to the invention, it is also possible to preferably shape toner particles which are out of the range of 1 μm or more and 4 μm or less in a volume average particle size and have an influence on flowability and transfer efficiency of the toner. Therefore, transfer efficiency to a recording medium and cleaning property can be further improved.

Further, the invention provides a method of manufacturing the toner, comprising:

a premixing step of mixing a toner raw material at least containing a binder resin and colorant so as to prepare a toner raw material mixture;

a melt-kneading step of melt-kneading the toner raw material mixture so as to prepare a resin composition;

a pulverizing step of pulverizing the resin composition so as to prepare a pulverized material;

a classifying step of classifying the pulverized material into first toner particles and excessively-pulverized toner particles having a smaller volume average particle size than that of the first toner particles;

a spheronizing step of performing a spheronization process on the excessively-pulverized toner particles so as to prepare second toner particles; and a mixing step of mixing the first toner particles and the second toner particles.

According to the invention, the toner is prepared by the steps described below. Firstly, in a premixing step, a toner raw material at least containing a binder resin and a colorant is mixed so as to prepare a toner raw material mixture. Next, the toner raw material mixture is melt-kneaded in a melt-kneading step so as to prepare a resin composition. And then, the resin composition thus obtained is pulverized in a pulverizing step so as to prepare a pulverized material. The pulverized material is thereafter classified in a classifying step, into first toner particles and excessively-pulverized toner particles having a smaller volume average particle size than that of the first toner particles. The excessively-pulverized toner particles are subsequently treated with a spheronization process in a spheronizing step so as to prepare second toner particles. Lastly, the first toner particles and the second toner particles are mixed in a mixing step. By manufacturing the toner as described above, it is possible to control the particle size distribution and to control the average degree of circularity and the circularity degree distribution of the toner particles having a volume average particle size of 1 μm or more and 4 μm or less. Further, it is possible to manufacture a toner which has a good cleaning property and exhibits high-level flowability and transfer efficiency and by using which a high-quality image high in definition and resolution can be formed.

Further, it is preferable that in the mixing step, the second toner particles are mixed with the first toner particles in a ratio of 3 parts by weight or more and 20 parts by weight or less on the basis of 100 parts by weight of the first toner particles.

According to the invention, this allows the content of the fine particles having a volume average particle size of 4 μm or less to more reliably fall in a preferred range in the toner. Therefore, a toner can be manufactured by using which it is possible to more reliably form a high-quality image of high definition and resolution.

Further, it is preferable that a volume average particle size of the first toner particles is 4 μm or more and 8 μm or less.

According to the invention, this allows the content of the fine toner particles having a volume average particle size of 4 μm or less to more easily fall in a preferred range. Therefore, it is possible to more easily manufacture a toner which has a good cleaning property and exhibits high-level flowability and transfer efficiency and by using which a high-quality image high in definition and resolution can be formed.

Further, it is preferable that a volume average particle size of the second toner particles is 3 μm or more and 5 μm or less.

According to the invention, this allows the content of the fine toner particles having a volume average particle size of 4 μm or less in the toner to more easily fail in a preferred range. Therefore, it is possible to more easily manufacture a toner by using which a high-quality image high in definition and resolution can be formed.

Further, it is preferable that in the spheronizing step, the second toner particles are manufactured by performing a spheronization process on the excessively-pulverized toner particles with the aid of mechanical impact or hot air.

According to the invention, this allows the average degree of circularity and the circularity degree distribution of the second toner particles to easily fall in preferred ranges. Therefore, it is possible to easily manufacture a toner which has a good cleaning property and exhibits high-level flowability and transfer efficiency and by using which a high-quality image high in definition and resolution can be formed.

Further, the invention provides a two-component developer containing the toner and a carrier.

According to the invention, the two-component developer of the invention contains a carrier, and the toner which has been controlled in respect of the particle size distribution and of the average degree of circularity and the circularity degree distribution of the toner particles having a volume average particle size of 1 μm or more and 4 μm or less. This makes it possible to form a high-quality image of high definition and resolution, by using the two-component developer containing the toner which has a good cleaning property and exhibits high-level flowability and transfer efficiency.

Further, the invention provides a developing device which performs development using the two-component developer.

According to the invention, the developing device performs development using the two-component developer, thus making it possible to form a high-definition and high-resolution toner image on the photoreceptor.

Further, the invention provides an image forming apparatus having the developing device.

According to the invention, the image forming apparatus can form a high-quality image of high definition and resolution, by using a toner of the invention which has a good cleaning property and exhibits high-level flowability and transfer efficiency.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
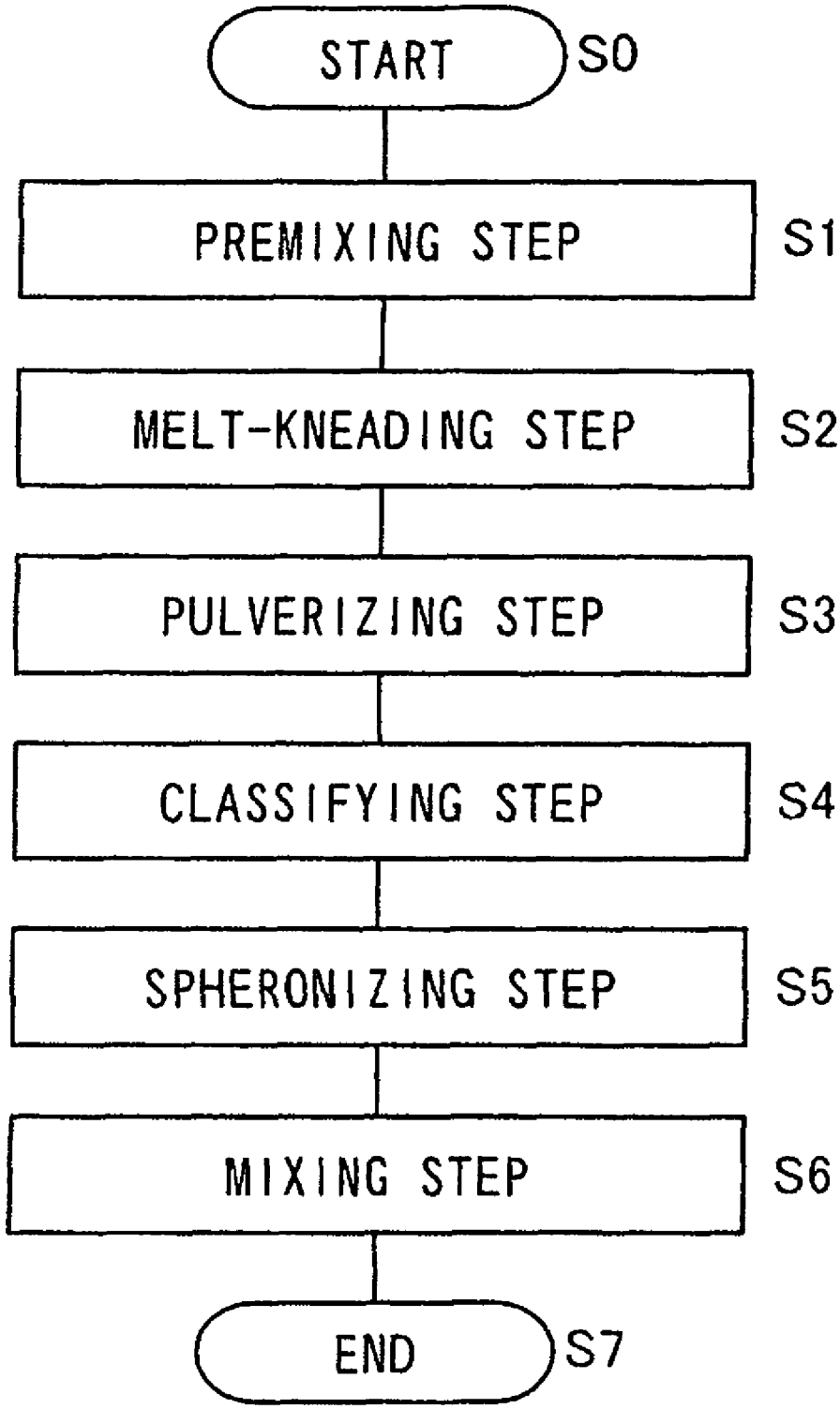
FIG. 1 is a flowchart showing procedures followed in a method of manufacturing a toner of the invention.

Now referring to the drawings, preferred embodiments of the invention are described below.

A toner of the invention at least contains a binder resin and a colorant, particle sizes $D_{50p}$ and $D_{84p}$ satisfy the following formula (1):

$$1.43 \leqq D_{50p}/D_{84p} \leqq 1.64 \quad (1)$$

wherein $D_{50p}$ and $D_{84p}$ respectively represent particle sizes at 50% and 84% of cumulative number counted from a large-size side in a cumulative number distribution. In the toner, an average degree of circularity of toner particles having a volume average particle size of 1 μm or more and 4 μm or less is 0.940 or more and 0.960 or less. Further, a content of toner particles having an average degree of circularity of 0.850 or less is 10% by number or less among the toner particles having a volume average particle size of 1 μm or more and 4 μm or less.

As described above, a control is performed on a particle size distribution of the toner as well as on the average degree of circularity and a circularity degree distribution of the toner particles having a volume average particle size of 1 μm or more and 4 μm or less (hereinbelow, referred to as "small-size particles"). This allows the toner to have a good cleaning property and exhibit high-level flowability and transfer efficiency, thus making it possible to form a high-quality image of high definition and resolution.

When the particle sizes $D_{50p}$ and $D_{84p}$ satisfy the above formula (1), and preferably the following formula (2), it is possible to cause a content of fine toner particles having a volume average particle size of 4 μm or Less to fall in a preferred range:

$$1.46 \leqq D_{50p}/D_{84p} \leqq 1.64 \quad (2)$$

This allows formation of a high-quality image high in definition and resolution. When $D_{50p}/D_{84p}$ is less than 1.43, the content of the fine toner particles is insufficient. This causes a failure to form a high-quality image sufficiently improved in definition and resolution. On the other hand, when $D_{50p}/D_{84p}$ exceeds 1.64, the content of the fine toner particles is excessive. This leads to a decrease in flowability, to occurrence of fogs caused by toner spattering and poor transfer efficiency, and to a decline in cleaning property.

Further, when the average degree of circularity of the small-size particles is set to be 0.940 or more and 0.960 or less, the small-size particles can be preferably shaped which are influential on flowability and transfer efficiency of the toner. This allows the toner to have a good cleaning property and exhibit high-level flowability and transfer efficiency. When the average degree of circularity of the small-size particles is less than 0.940, the toner particles become amorphous, thus causing a failure to improve flowability and transfer efficiency. On the other hand, when the average degree of circularity of the small-size particles exceeds 0.960, the shapes of the toner particles are close to perfect sphere, thus causing the toner to be less easily scraped by a cleaning blade. This results in a decrease in cleaning property, thus making it difficult to remove toner particles which remain left on a surface of a photoreceptor drum after a toner image has been transferred onto a recording medium.

Further, when the content of the toner particles having an average degree of circularity of 0.850 or less are set to be 10% by number or less in the small-size particles, it is possible to restrain a content of an amorphous toner which is low in transfer efficiency and has an average degree of circularity of, for example, 0.850 or less. This allows the circularity degree distribution to be narrowed. Therefore, it is possible to maintain high transfer efficiency and stably form a high-quality image. On the other hand, when the content of the toner particles having an average degree of circularity of 0.850 or less exceeds 10% by number, the content of the amorphous toner is increased. This results in a decrease in the transfer efficiency, thus making it difficult to obtain a high-definition image.

Further, in the toner, a content of the small-size particles is preferably set to be 20% by number or more and 50% by number or less on the basis of the entire toner particles. When the content of the small-size particles is set to fall in the above range, it is possible to retain a high resolution and cause a charge amount of the toner particles to remain in a predetermined range. This makes it possible to further improve image quality of a formed image. When the content of the small-size particles is less than 20% by number, image resolution may decline undesirably. On the other hand, when the content of the small-size particles exceeds 50% by number, toner spattering may occur due to low flowability and fogs may occur due to poor transfer efficiency. In addition, there may cause such a problem that the photoreceptor is poorly cleaned and a bad influence may be exerted on the formed image.

Further, in the toner of the invention, the average degree of circularity of the entire toner particles is preferably set to be 0.955 or more and 0.975 or less. When the average degree of circularity of the entire toner particles is set to be in the above range, it is also possible to preferably shape toner particles other than the small-size particles which have an influence on flowability and transfer efficiency of the toner. Therefore, it is possible to further improve the efficiency in the transferring of the toner onto the recording medium and the cleaning property. When the average degree of circularity of the entire toner particles is less than 0.955, the content of the amorphous toner is increased, thus causing a decline in transfer efficiency. On the other hand, when the average degree of circularity of the entire toner particles exceeds 0.975, the content of the toner having a shape close to a perfect sphere is increased, thus causing a decline in cleaning property.

Herein, a degree of circularity of toner particles (ai) is defined by the following formula (3). The degree of circularity (ai) as defined by the formula (3) is measured by using a flow particle image analyzer FPIA-3000 manufactured by Sysmex Corporation, for example. An average degree of circularity (a) is defined by an arithmetic mean value which is calculated according to a formula (4) by dividing a sum of respective degrees of circularity (ai) of "m" pieces of toner particles by the number of toner particles, i.e. "m".

$$\text{Degree of circularity } (ai) = (\text{Circumference length of circle having the same projection area as that of particle image})/(\text{Peripheral length of projection image of particles}) \quad (3)$$

$$\text{Average degree of circularity}(a) = \sum_{i=1}^{m} ai/m \quad (4)$$

The above measurement apparatus FPIA-3000 uses a simple method for estimation composed of steps of: calculating degrees of circularity (ai) of the respective toner particles, determining a frequency in each of 61 divisions sectioned for every 0.01 from 0.40 to 1.00 in the obtained degrees of circularity (ai) of the respective toner particles, and calculating an average degree of circularity based on a center value and the frequency of each of the divisions. A value of the average degree of circularity (a) calculated by the simple method for estimation differs very little from a value of the average degree of circularity (a) provided by the above formula (4), and an error therebetween can be substantially neglected. Therefore, in the present embodiment, the average degree of circularity obtained by the simple method for estimation is regarded as the average degree of circularity (a) defined by the above formula (4).

A specific method of determining the average degree of circularity (ai) is as follows. Into 10 mL of water in which approximately 0.1 mg surfactant is dissolved, 5 mg of toner was dispersed, thus to prepare a dispersion solution. The dispersion solution was then irradiated for five minutes by ultrasonic wave with frequency of 20 kHz and output of 50 W. Then, with use of the above apparatus FPIA-3000, the degree of circularity (ai) was measured by assuming a concentration of toner particles in the dispersion solution to be in a range of from 5,000 pieces/μL to 20,000 pieces/μL. The average degree of circularity (a) was thus determined.

Further, a volume average particle size ($D_{50V}$) and the number average particle sizes ($D_{50p}$, $D_{84p}$) are measured by a Coulter counter (trade name: Multisizer 3; manufactured by Beckman Coulter, Inc.). The conditions for measuring particle sizes are as follows.

Aperture diameter: 20 μm

Number of particles for measurement: 50,000 counts

Analysis software: Coulter Multisizer AccuComp Version 1.19 (manufactured by Beckman Coulter, Inc.)

Electrolyte: ISOTON-II (manufactured by Beckman Coulter, Inc.)

Dispersant: sodium alkyl ether sulfate

Measurement method: Into a beaker, 50 ml of electrolyte, 20 mg of a specimen, and 1 ml of dispersant were added and then dispersed for three minutes by an ultrasonic disperser to prepare a sample for measurement. Particle sizes were measured by using the above Coulter counter Multisizer 3. A volume particle size distribution and a number particle size distribution of the sample particles were determined based on the results thus measured. On the basis of these particle size distributions, the volume average particle size ($D_{50V}$) and the number average particle sizes ($D_{50p}$, $D_{84p}$) were then calculated. Further, the content of the particles having a volume average particle size of 1 μm or more and 4 μm or less was determined on the basis of these particle size distributions. Herein, the volume average particle size refers to the particle size $D_{50V}$, wherein $D_{50V}$ represents a particle size at 50% of cumulative volume counted from a large-size side in a cumulative volume distribution.

Hereinbelow, descriptions will be given to a method of manufacturing the toner of the invention. FIG. 1 is a flowchart showing procedures followed in the method of manufacturing the toner of the invention. As shown in FIG. 1, the method of manufacturing the toner includes a premixing step (Step S1) of mixing a toner raw material at least containing a binder resin and a colorant so as to prepare a toner raw material mixture; a melt-kneading step (Step S2) of melt-kneading the toner raw material mixture so as to prepare a resin composition; a pulverizing step (Step S3) of pulverizing the resin composition so as to prepare a pulverized material; a classifying step (Step S4) of classifying the pulverized material into first toner particles and excessively-pulverized toner particles having a smaller volume average particle size than that of the first toner particles; a spheronizing step (Step S5) of performing a spheronization process on the excessively-pulverized toner particles so as to prepare second toner particles; and a mixing step (Step S6) of mixing the first toner particles and the second toner particles. By using the above manufacturing method, it is possible to control the particle size distributions of the toner, and control the average degree of circularity and the circularity degree distribution of the small-size particles. This makes it possible to manufacture a toner which has a good cleaning property and exhibits high-level flowability and transfer efficiency and by using which a high-quality image of high definition and resolution can be formed.

Next, the respective steps S1-S6 of manufacturing the toner will be described in detail. The manufacturing of the toner is started at Step S0 and then the procedure proceeds to Step S1.

[Premixing Step]

In the premixing step of Step S1, the toner raw material at least containing a binder resin and colorant is dry-mixed by a mixer so as to prepare the toner raw material mixture. In addition to the binder resin and the colorant, the toner raw material may also contain other toner additives. As the other toner additives, a release agent, a charge control agent, and so forth can be used, for example.

The mixers usable for the dry-mixing operation include, for example, Henschel-type mixing apparatuses such as a Henschel mixer (trade name: FM MIXER) manufactured by Mitsui Mining Co., Ltd., SUPERMIXER (trade name) manufactured by KAWATA MFG Co., Ltd., and MECHANOMILL (trade name) manufactured by Okada Seiko Co., Ltd., ANGMILL (trade name) manufactured by Hosokawa Micron Corporation, HYBRIDIZATION SYSTEM (trade name) manufactured by Nara Machinery Co., Ltd., and COSMOSYSTEM (trade name) manufactured by Kawasaki Heavy Industries, Ltd.

The above toner raw material will be described below.

(a) Binder Resin

A selection of the binder resin is not particularly limited, and usable is a binder resin for black toner or color toner. Examples of the binder resin include: polyester-based resin; styrene-based resin such as polystyrene and styrene-acrylic ester copolymer resin; acryl-based resin such as polymethylmethacrylate; polyolefin-based rein such as polyethylene; polyurethane; and epoxy resin. It is also possible to use resin which is obtained by mixing a release agent into a raw material monomer mixture to thereby effect a polymerization reaction. The binder resins may be used each alone, or two or more of the binder resins may be used in combination.

A glass transition temperature (Tg) of the binder resin is not particularly limited and can be appropriately selected from a broad range. However, considering fixing property and storage stability of a manufactured toner, the glass transition temperature (Tg) of the binder resin is preferably selected to be 30° C. or more and 80° C. or less. When the glass transition temperature (Tg) of the binder resin is less than 30° C., heat aggregation of toners easily occurs inside the image forming apparatus due to insufficient storage stability, which may cause poor development undesirably. Further, there is an undesirable drop in a temperature at which high-temperature offset phenomenon begins to occur (hereinafter, referred to as "high-temperature offset-starting temperature"). The high-temperature offset phenomenon refers to a phenomenon in which, when a toner is heated and pressurized by a fixing member such as a heating roller so as to be fixed onto a recording medium, the overheating of the toner causes that an aggregation force of toner particles becomes lower than an adhesive force between the toner and the fixing member, so that a toner layer is segmented and the toner is partially removed by adherence to the fixing member. On the other hand, when the glass transition temperature (Tg) of the binder resin exceeds 80° C., poor fixing may occur due to a decline in fixing property.

A softening temperature (Tm) of the binder resin is not particularly limited and may be appropriately selected from a broad range, and preferably to be 150° C. or less, and more preferably to be 60° C. or more and 150° C. or less. When the softening temperature (Tm) of the binder resin is less than 60° C., the storage stability of the toner deteriorates and the heat aggregation of toners easily occurs inside the image forming apparatus. This causes a failure to stably feed toner to an image bearer and poor development easily occurs. Further, this also may induce a breakdown of the image forming apparatus. On the other hand, when the softening temperature (Tm) of the binder resin exceeds 150° C., the binder resin less easily melts in the melt-kneading step, thus resulting in difficulty in kneading the toner raw material. This may cause the colorant, the release agent, the charge control agent, and so forth to be poorly dispersed in the kneaded material. Further, when the toner is fixed to the recording medium, the toner hardly melts or softens, thus possibly causing that the toner is poorly fixed to the recording medium and poor fixing occurs undesirably.

(b) Colorant

The colorant includes, for example, a colorant for yellow toner, a colorant for magenta toner, a colorant for cyan toner, and a colorant for black toner.

Examples of the colorant for yellow toner include: azoic pigments such as C.I. pigment yellow 1, C.I. pigment yellow 5, C.I. pigment yellow 12, C.I. pigment yellow 15, and C.I. pigment yellow 17, inorganic pigments such as yellow ferric oxide and ocher, nitro dyes such as C.I. acid yellow 1, oil-soluble dyes such as C.I. solvent yellow 2, C.I. solvent yellow 6, solvent yellow 14, C.I. solvent yellow 15, C.I. solvent yellow 19, and C.I. solvent yellow 21, which are classified by Color Index.

Examples of the colorant for magenta toner include: C.I. pigment red 49, C.I. pigment red 57:1, C.I. pigment red 57, C.I. pigment red 81, C.I. pigment red 122, C.I. solvent red 19, C.I. solvent red 49, C.I. solvent red 52, C.I. basic red 10, and C.I. disperse red 15, which are classified by Color Index.

Examples of the colorant for cyan toner include: C.I. pigment blue 15, C.I. pigment blue 16, C.I. solvent blue 55, C.I. solvent blue 70, C.I. direct blue 25, and C.I. direct blue 86, which are classified by Color Index.

Examples of the colorant for black toner include carbon black such as channel black, roller black, disc black, gas furnace black, oil furnace black, thermal black, and acethylene black. Among these various types of carbon black, suitable carbon black may be appropriately selected in accordance with the design characteristics of the intended toner.

Apart from those pigments, also usable herein are red pigments, green pigments, and the like pigments. The colorants may be used each alone, or two or more of the colorants may be used in combination. Further, two or more colorants of the same color type may be combined, or one or more colorants of one color type may be combined with those of a different color type.

The colorant is preferably used in form of master batch. The master batch of the colorant can be manufactured, for example, by kneading a molten material of synthetic resin and colorant. The synthetic resin used is a binder resin of the same sort as the binder resin of the toner, or resin which is well-compatible with the binder resin of the toner. A use ratio of the colorant is, although not particularly limited, preferably 23 parts by weight or more and 50 parts by weight or less on the basis of 100 parts by weight of the master batch. Before being used, the master batch is granulated so as to approximately have a particle size of 2 mm to 3 mm, for example.

A content of the colorant in the toner is, although not particularly limited, preferably 4 parts by weight or more and 20 parts by weight or less on the basis of 100 parts by weight of the binder resin. In the case of using the master batch, a usage of the master batch is preferably adjusted so that the content of the colorant in the toner of the invention falls in the above range. The use of the colorant in the above range allows formation of favorable images which are sufficient in image density and excellent in color development and image quality.

(c) Release Agent

The toner raw material can contain, other than the binder resin and the colorant, components to be added to the toner, such as a release agent. When the release agent is contained in the toner, an anti-offset effect can be enhanced. Examples of the release agent include petroleum wax such as paraffin wax and derivatives thereof, and microcrystalline wax and derivatives thereof; hydrocarbon-based synthetic wax such as Fischer-Tropsch wax and derivatives thereof, polyolefin wax and derivatives thereof, low-molecular polypropylene wax and derivatives thereof, and polyolefinic polymer wax and derivatives thereof; vegetable wax such as carnauba wax and derivatives thereof, rice wax and derivatives thereof, candelilla wax and derivatives thereof, and haze wax; animal wax such as bees wax and spermaceti wax; fat and oil-based synthetic wax such as fatty acid amides and phenolic fatty acid esters; long-chain carboxylic acids and derivatives thereof; long-chain alcohols and derivatives thereof; silicone polymers; and higher fatty acids. Examples of the derivatives include oxides, block copolymers of vinylic monomer and wax, and copolymers of vinylic monomer and wax. A usage of the release agent may be appropriately selected from a wide range without particular limitation, and preferably 0.2 part by weight or more and 20 parts or less by weight based on 100 parts by weight of the binder resin.

A melting point of the release agent is preferably selected to be 50° C. or more and 150° C. or less, more preferably to be 120° C. or less. When the melting point of the release agent is less than 50° C., the release agent melts and toner particles aggregate in the developing device, which may induce, for example, poor filming of the surface of the photoreceptor. On the other hand, when the melting point of the release agent exceeds 150° C., the release agent fails to fully elute off in fixing the toner to the recording medium, which may result in a failure to sufficiently enhance an anti-high-temperature offset property. Herein, the melting point of the release agent refers to a temperature of a melting endothermic peak in a differential scanning calorimetric (abbreviated as DSC) curve obtained by DSC measurement.

(d) Charge Control Agent

The toner raw material described above may contain, other than the binder resin and the colorant, a charge control agent as a component to be added to the toner. When the charge control agent is contained, it is possible to cause a frictional charge amount of the toner to fall in a favorable range. As the charge control agent, usable is a charge control agent for positive charge control, or a charge control agent for negative charge control. Examples of the charge control agent for positive charge control include a basic dye, quaternary ammonium salt, quaternary phosphonium salt, aminopyrine, a pyrimidine compound, a polynuclear polyamino compound, aminosilane, a nigrosine dye and its derivatives, a triphenylmethane derivative, guanidine salt, and amidine salt. Examples of the charge control agent for negative charge control include oil-soluble dyes such as oil black and spiron black; a metal-containing azo compound; an azo complex dye; metal salt naphthenate; salicylic acid; metal complex and metal salt (the metal includes chrome, zinc, and zirconium) of a salicylic acid derivative; a boron compound; a fatty acid soap; long-chain alkylcarboxylic acid salt; and a resin acid soap. The charge control agents just cited may be used each alone, and two or more of the charge control agents may be used in combination. A usage of the charge control agent may be appropriately selected from a wide range without particular limitation, and preferably 0.5 part by weight or more and 3 parts by weight or less on the basis of 100 parts by weight of the binder resin.

[Melt-Kneading Step]

In the melt-kneading step of Step S2, the toner raw material mixture prepared by the premixing step is melt-kneaded so as to prepare a resin composition. The melt-kneading of the toner raw material mixture is performed at a temperature which is equal to or higher than the softening temperature of the binder resin and less than a pyrolysis temperature of the binder resin. By the melt-kneading step, the binder resin is melted or softened so that the toner raw material other than the binder resin is dispersed into the binder resin.

For melt-kneading, it is possible to use kneading machines such as a kneader, a twin-screw extruder, a two roll mill, a three roll mill, and laboplast mill. Examples of such kneading machines include single or twin screw extruders such as TEM-100B (trade name) manufactured by Toshiba Machine Co., Ltd., PCM-65 and PCM-30, both of which are trade names and manufactured by Ikegai Ltd., and open roll-type kneading machines such as KNEADEX (trade name) manufactured by Mitsui Mining Co., Ltd. The toner raw material mixture may be melt-kneaded by using a plurality of the kneading machines. A melt-kneaded material obtained by the melt-kneading step is then cooled down to be solidified, resulting in a resin composition.

[Pulverizing Step]

In the pulverizing step of Step S3, the resin composition produced by the melt-kneading step is pulverized so as to prepare a pulverized material. The resin composition is pulverized by a mixer such as a hammer mill or a cutter mill to form a coarsely-pulverized material approximately having a particle size of 100 μm or more and 5 mm or less. And then, the obtained coarsely-pulverized material is further pulverized to form a pulverized material having a particle size of 15 μm or less, for example. Examples of machines usable for pulverizing the coarsely-pulverized material include a jet pulverizer for pulverizing by use of a supersonic jet airflow, and a colliding airflow pulverizer. The colliding airflow pulverizer introduces the coarsely-pulverized material into a space formed between a rotating part (a rotor) rotating at a high speed and a stationary part (a liner) so as to pulverize the coarsely-pulverized material thus introduced.

[Classifying Step]

In the classifying step of Step S4, the pulverized material obtained by the pulverizing step is classified into the first toner particles and the second toner particles having a smaller volume average particle size than that of the first toner particles. The pulverized material contains excessively-pulverized toner particles having a volume average particle size of 4.0 μm or less, for example.

The first toner particles are obtained by performing classification and removing the excessively-pulverized toner particles from the pulverized material. The classification condition can be appropriately adjusted. The classification is desirably performed so that a volume average particle size of the first toner particles obtained after the classification preferably is 4 μm or more and 8 μm or less, and more preferably 5 μm or more and 6 μm or less. This makes it easier to cause a content of the fine toner particles having a volume average particle size of 4 μm or less in the toner to fall in a favorable range. Therefore, it is possible to manufacture more easily a toner which has a good cleaning property and exhibits high-level flowability and transfer efficiency and by using which a high-quality image of high definition and resolution can be formed. When the volume average particle size of the first toner particles is less than 4 μm the content of the fine toner particles is too high in the toner. This may lead to a decline in flowability, to occurrence of fogs caused by toner spattering and poor transfer efficiency, and to deterioration in the cleaning property. Further, the manufacturing of the toner may also become difficult. On the other hand, the volume average particle size of the first toner particles is too large when exceeding 8 μm. This may cause a failure to obtain a high-definition image. Further, toner particles having a larger volume average particle size form a toner having a smaller specific surface area and thus a lower charge amount. A decrease in the charge amount of the toner may undesirably result in a failure to stably feed the toner to the photoreceptor and in occurrence of pollution inside the device caused by toner spattering. The to-be-adjusted classification condition described above refers to a rotation speed of a classifying rotor in a rotary wind classifier and the like element, for example.

[Spheronizing Step]

In the spheronizing step of Step S5, the excessively-pulverized toner particles removed from the pulverized material in the classifying step are treated with the spheronization process so as to prepare the second toner particles. For performing the spheronization process, usable are, for example, a method of forming spherical shape by use of mechanical impact force, a method of forming spherical shape by use of hot air, and the like method.

Figure 2:
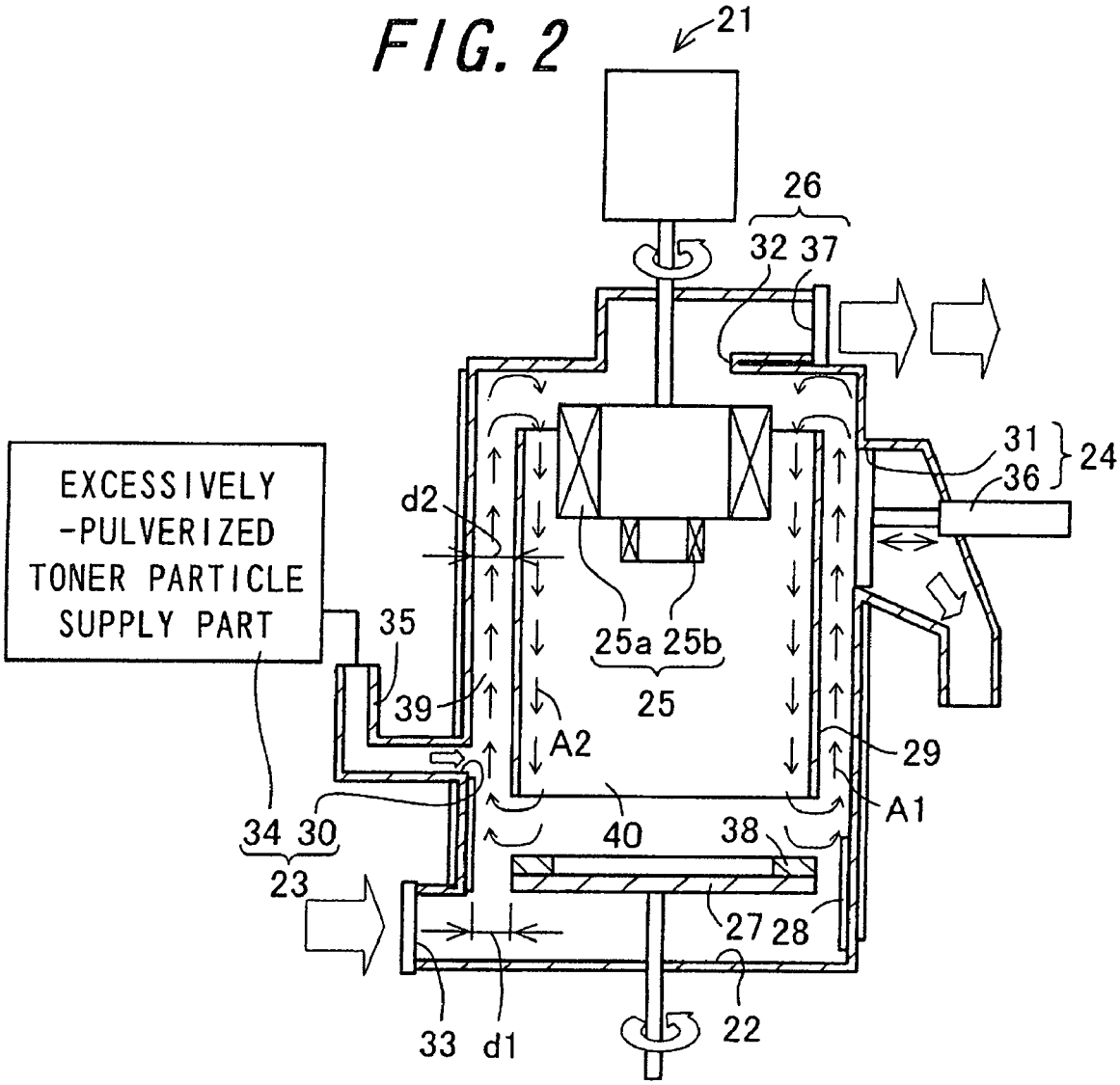
FIG. 2 is a sectional view schematically showing a configuration of an impact-type spheronizing device.

Hereinbelow, descriptions will be given to the method of forming the excessively-pulverized toner particles into spherical shapes by use of mechanical impact force. FIG. 2 is a sectional view schematically showing a configuration of an impact-type spheronizing device 21. The impact-type spheronizing device 21 uses the mechanical impact force to form the excessively-pulverized particles into spherical shapes. The impact-type spheronizing device 21 includes a treatment tank 22, an excessively-pulverized toner particle input portion 23, a second-toner-particle discharge portion 24, a classifying rotor 25, a fine-particle discharge portion 26, a dispersing rotor 27, a liner 28, and a partition member 29.

The treatment tank 22 is a substantially cylindrical container for treatment. Inside the treatment tank 22, the classifying rotor 25 is disposed in an upper part, and on side walls of the treatment tank 22 are formed an excessively-pulverized toner particle inlet 30 of the excessively-pulverized toner particle input portion 23 and a second-toner-particle outlet 31 of the second-toner-particle discharge portion 24. Further, a fine-particle outlet 32 of the fine-particle discharge portion 26 is formed on the side wall of the treatment tank 22 higher than the classifying rotor 25. At a bottom part of the treatment tank 22 are disposed the dispersing rotor 27 and the liner 28. Further, in the present embodiment, at the bottom part of the treatment tank 22 is formed a cooled air inlet 33 for letting the cooled air flow into the treatment tank 22. An internal diameter of the treatment tank 22 according to the embodiment is 20 cm.

The excessively-pulverized toner particle input portion 23 includes an excessively-pulverized toner particle supply part 34, a pipeline 35, and an excessively-pulverized toner particle inlet 30. The excessively-pulverized toner particle supply part 34 includes a storage container (not shown), a vibration feeder (not shown), and a compressed air intake nozzle (not shown) The storage container is a container-like member having an internal space where the excessively-pulverized toner particles are temporarily stored. Further, one end of the pipeline 35 is connected to one side surface or a bottom surface of the storage container, which communicates an internal space of the storage container and an internal space of the pipeline 35 with each other. The vibration feeder is disposed so that the storage container vibrates by vibration of the vibration feeder. The vibration feeder supplies the excessively-pulverized toner particles in the storage container into the pipeline 35. The compressed air intake nozzle is disposed so as to be connected to the pipeline 35 in the vicinity of a connection portion between the storage container and the pipeline 35. The compressed air intake nozzle supplies the compressed air into the pipeline 35 and accelerates the flow of the excessively-pulverized toner particles inside the pipeline 35 toward the excessively-pulverized toner particle inlet 30. The pipeline 35 is a pipe-like member which has one end connected to the storage container and the other end connected to the excessively-pulverized toner particle inlet 30. Through the pipeline 35, a mixture of the excessively-pulverized toner particles supplied from the storage container and the compressed air supplied from the compressed air intake nozzle is blown off from the excessively-pulverized toner particle inlet 30 toward the inside of the treatment tank 22.

In the excessively-pulverized toner particle supply part 34 as stated above, the compressed air is firstly introduced from the compressed air intake nozzle into the pipeline 35 and at the same time, the excessively-pulverized toner particles stored inside the storage container are made to vibrate by the vibration feeder and thereby supplied from the storage container to the pipeline. The excessively-pulverized toner particles supplied to the pipeline are delivered by pressure with the aid of the compressed air introduced from the compressed air intake nozzle, and then introduced into the treatment tank 22 from the excessively-pulverized toner particle inlet 30 connected to a downstream side in an air intake direction of the pipeline 35.

The second-toner-particle discharge portion 24 includes a second-toner-particle discharge valve 36 and a second-toner-particle outlet 31. The second-toner-particle discharge portion 24 discharges to the outside of the treatment tank 22 the toner particles which are the second toner particles formed into spherical shapes inside the treatment tank 22. The second-toner-particle discharge valve 36 is opened after a lapse of a predetermined treatment time. The opening of the second-toner-particle discharge valve 36 causes the second toner particles to be discharged from the second-toner-particle outlet 31.

Figure 3:
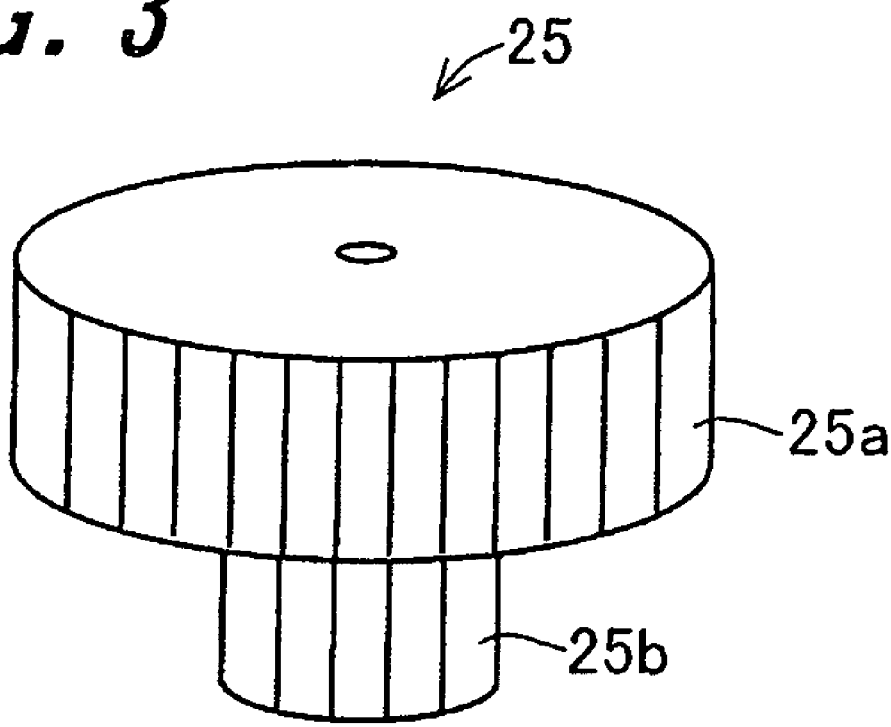
FIG. 3 is a perspective view showing a configuration of a classifying rotor disposed in the impact-type spheronizing device.

FIG. 3 is a perspective view showing a configuration of the classifying rotor 25 disposed in the impact-type spheronizing device 21. The classifying rotor 25 is a rotor for removing fine particles having a volume average particle size of less than 3 μm, for example, contained in the excessively-pulverized toner particles which have been fed from the excessively-pulverized toner particle input portion 23. The classifying rotor 25 classifies the excessively-pulverized toner particles in accordance with a particle size, by utilizing the difference in centrifugal force given to the excessively-pulverized toner particles depending on the weight of the excessively-pulverized toner particles.

In the present embodiment, the classifying rotor 25 includes a first classifying rotor 25*a* and a second classifying rotor 25*b*. The second classifying rotor 25*b* is disposed below the first classifying rotor 25*a* and rotates in the same direction as that of the first classifying rotor 25*a*. Such an arrangement that the second classifying rotor 25*b* is disposed below the first classifying rotor 25*a* allows the excessively-pulverized toner particles to be effectively dispersed even when the excessively-pulverized toner particles have been aggregated, thus removing fine particles without fail.

Referring to FIG. 2, above the classifying rotor 25 inside the treatment tank 22 is formed the fine-particle outlet 32 through which the fine particles classified by the classifying rotor 25 are discharged. The fine-particle discharge portion 26 includes the fine-particle outlet 32 and a fine-particle discharge valve 37 which is open during the spheronization process of the excessively-pulverized toner particles.

In a lower part inside the treatment tank 22 are disposed the dispersing rotor 27 and the liner 28. The dispersing rotor 27 is composed of a circular plate member and a support shaft. The circular plate member is supported by the support shaft so that a circular surface of the circular plate member is parallel to a bottom surface of the treatment tank 22. An outer peripheral part in an upper surface in a vertical direction of the circular plate member is provided with a blade 38. The support shaft has one end connected to a lower surface in a vertical direction of the circular plate member and the other end connected to a drive mechanism (not shown). The support shaft supports the circular plate member and transfers to the circular plate member the rotary drive which is caused by the drive mechanism, in the same direction as that of the classifying rotor 25. This rotates the dispersing rotor 27 in the same direction as that of the classifying rotor 25. The liner 28 is a plate member which is provided at a position of an inner wall surface of the treatment tank 22, opposed to side surfaces of the circular plate member of the dispersing rotor 27 and the blade 38, so as to be fixed on the inner wall surface in contact therewith. In a surface of the blade 38 opposed to the side surfaces in the vertical direction of the circular plate member of the dispersing rotor 27 and the blade 38, one or more grooves extending in substantially parallel with the vertical direction are formed.

A clearance d1 between the dispersing rotor 27 and the liner 28 is preferably 1.0 mm or more and 3.0 mm or less. The clearance d1 in such a range allows an easy manufacture of the second toner particles having desired shapes without increasing the burden on the device. When the clearance d1 between the dispersing rotor 27 and the liner 28 is less than 1.0 mm, the excessively-pulverized toner particles will be further pulverized during the spheronization process, which may cause the excessively-pulverized toner particles to be softened by heat. The excessively-pulverized toner particles thus softened will cause the second toner particles to be denatured and moreover, be attached to the dispersing rotor 27, the liner 28, and the other part, which increases the load on the device. This will result in a decrease in productivity of the second toner particles. When the clearance d1 between the dispersing rotor 27 and the liner 28 exceeds 3.0 mm, a rotation speed of the dispersing rotor 27 needs to be set higher in order to obtain second toner particles having a high degree of circularity, which also causes the excessively-pulverized toner particles to be further pulverized. Pulverization of the excessively-pulverized toner particles will cause the excessively-pulverized toner particles to be softened, thus ending up with the same problem as mentioned above.

Above the dispersing rotor 27 inside the treatment tank 22 is disposed the partition member 29. The partition member 29 is a substantially cylindrical member for segmenting the inside of the treatment tank 22 into a first space 39 and a second space 40. A size of the partition member 29 is, when viewed in a radial direction thereof, smaller than a size of the dispersing rotor 27 and larger than a size of the classifying rotor 25. The first space 39 is a space located on a side of the inner wall surface inside the treatment tank 22 when viewed in the radial direction of the treatment tank 22. The second space 40 is a space located on an opposite side of the inner wall surface inside the treatment tank 22 when viewed in the radian direction of the treatment tank 22. The first space 39 is a space for leading to the classifying rotor 25 the excessively-pulverized toner particles taken in and the excessively-pulverized toner particles formed into spherical shapes. The second space 40 is a space for forming the excessively-pulverized material toner particles into spherical shapes with the aid of the dispersing rotor 27 and the liner 28.

A clearance d2 between one end of partition member 29 (hereinafter referred to as "an end of the partition member 29") located on the side of the inner wall surface of the treatment tank 22 when viewed in the radial direction thereof, and the inner wall surface of the treatment tank 22 is preferably 20.0 mm or more and 60.0 mm or less. When the clearance d2 between the end of the partition member 29 and the inner wall surface of the treatment tank 22 falls into such a range, the spheronization process can be efficiently carried out in a short time without increasing the burden on the device. When the clearance d2 between the end of the partition member 29 and the inner wall surface of the treatment tank 22 is less than 20.0 mm, an area of the second space 40 is too large and a residence time of the excessively-pulverized toner particles circling in the second space 40 is short, which may result in insufficient spheronization of the excessively-pulverized toner particles. This may cause a decrease in the productivity of the second toner particles. When the clearance d2 between the end of the partition member 29 and the inner wall surface of the treatment tank 22 exceeds 60.0 mm, the residence time of the excessively-pulverized toner particles around the dispersing rotor 27 is long and the excessively-pulverized toner particles are further pulverized during the spheronization process, which may cause surfaces of the excessively-pulverized toner particles to be molten. This may lead to alteration of the surfaces of the excessively-pulverized toner particles and fusion of the excessively-pulverized toner particles inside the device.

In the present embodiment, at the bottom part of the treatment tank 22 below the dispersing rotor 27 when viewed in the vertical direction is provided with the cooled air inlet 33 for letting the cooled air flow into the treatment tank 22. The cooled air inlet 33 is used to let the air cooled down in a cooling process flow into the treatment tank 22. The cooled air inlet 33 is connected to a cooled air supply portion (not shown) so that the cooled air generated in the device is led into the treatment tank 22.

A temperature inside the treatment tank 22 rises up by collision of the excessively-pulverized toner particles against the blade 38, the liner 28, the inner wall surface of the treatment tank 22, the partition member 29, etc. The cooled air inlet 33 helps the temperature inside the treatment tank 22 decrease by introducing the cooled air into the treatment tank 22. The temperature and inflow volume of the cooled air are not particularly limited and are determined in accordance with the rotation speed of the dispersing rotor 27, the size of the treatment tank 22, and the like element so that the temperature inside the treatment tank 22 is equal to or less than the glass transition temperature of the binder resin contained in the excessively-pulverized toner, for example, from 20° C. to 40° C. A thermometer may be disposed inside the treatment tank 22 to measure the temperature inside the treatment tank 22. Alternatively, a temperature of the air discharged from the fine-particle outlet 32 together with the fine particles may be measured to determine the temperature inside the treatment tank 22 since the temperature of the air substantially corresponds to the temperature inside the treatment tank 22. In the embodiment, the cooled air of from 0° C. to 2° C. is taken into the treatment tank 22. In this case, the temperature of the air discharged from the Line-particle outlet 32 together with the fine particles is approximately 50° C.

The impact-type spheronizing device 21 having the configuration as described above forms the excessively-pulverized toner particles into spherical shapes as follows. First of all, the classifying rotor 25 and the dispersing rotor 27 are driven to rotate, and in a state where the fine-particle discharge valve 37 is open, a predetermined amount of the excessively-pulverized toner particles are put into the treatment tank 22 by the excessively-pulverized toner particle input portion 23. The excessively-pulverized toner particles are put into the first space 39 inside the treatment tank 22. An amount of the excessively-pulverized toner particles fed by the excessively-pulverized toner particle input portion 33 is determined in accordance with the processing ability of the device. The processing ability of the device is determined by the size of the treatment tank 22, the rotation speed of the dispersing rotor 27, and the like element. The excessively-pulverized toner particles fed by the excessively-pulverized toner particle input portion 23 circle in the first space 39 by the rotation of the classifying rotor 25 and the dispersing rotor 27 and are directed to an upper part of the treatment tank 22 as illustrated by an arrow A1 until the excessively pulverized toner particles reach the classifying rotor 25.

The excessively-pulverized toner particles risen up to the classifying rotor 25 circle by the rotation of the classifying rotor 25, and the centrifugal force is thus imparted to the excessively-pulverized toner particles. The excessively-pulverized toner particles having small weights pass through the classifying rotor 25 and then are discharged from the fine-particle outlet 32 since the centrifugal force acted on the excessively-pulverized toner particles having small weights is smaller than the centrifugal force acted on the excessively-pulverized toner particles having large weights. The excessively-pulverized toner particles which have failed to be discharged from the fine-particle cutlet 32, circle in the second space 40 and are thus directed downward in an arrow A2 direction When the excessively-pulverized toner particles reach the dispersing rotor 27, the excessively-pulverized toner particles are formed into spherical shapes by collision against the blade 38 of the dispersing rotor 27, collision against the liner 28, and the like action, thereafter moving back to the first space 39.

The excessively-pulverized toner particles moved to the first space 39 rise again up to the classifying rotor 25, and the excessively-pulverized toner particles having small weights are discharged from the fine-particle outlet 32. The excessively-pulverized toner particles which are not discharged from the fine-particle outlet 32, circle again in the second space 40 and are directed downward to the dispersing rotor 27 to be formed into spherical shapes.

The process just described is repeated, and after a Lapse of a predetermined time, the second-toner-particle discharge valve 36 of the second-toner-particle discharge portion 24 is opened. When the second-toner-particle discharge valve 36 is opened, the excessively-pulverized toner particles present in the first space 39 are discharged from the second-toner-particle outlet 31. The excessively-pulverized toner particles thus discharged from the second-toner-particle outlet 31 are excessively pulverized toner particles which have been treated with the spheronization process. Such particles are the second toner particles. As described above, the excessively-pulverized toner particles can be formed into spherical shapes.

A length of time for the spheronization process is, although not particularly limited, preferably 5 seconds or more and 240 seconds or less, and more preferably 30 seconds or more and 240 seconds or less. When the length of time for the spheronization process is 5 seconds or more and 240 seconds or less, it is easy to obtain the second toner particles having desired shapes. When the length of time for the spheronization process is 30 seconds or more and 240 seconds or less, the entire excessively-pulverized toner particles can be uniformly formed into spherical shapes and moreover, the fine particles can be reliably removed. Therefore, it is more preferable to set the time for the spheronization process in the range of from 30 to 240 seconds.

When the length of time for the spheronization process is less than 5 seconds, the average degree of circularity of the excessively-pulverized toner particles fails to be increased, which may result in a failure to obtain the second toner particles having desired shapes. When the length of time for the spheronization process exceeds 240 seconds, the length of time for the spheronization process is too long and the surfaces of the toner particles are easily denatured by heat generated by the spheronization process, which may cause the excessively-pulverized toner particles to be fused inside the device. This leads to a decrease in the productivity of the second toner particles.

According to the impact-type spheronizing device 21 as described above, the fine particles are removed by the classifying rotor 25 and there is thus no need to provide a separate classifying step. From such a viewpoint, the impact-type spheronizing device 21 is preferred.

For the impact-type spheronizing device 21 as described above, commercially-available devices are also usable including, for example, FACULTY (trade name) manufactured by Hosokawa Micron Corporation.

Figure 4:
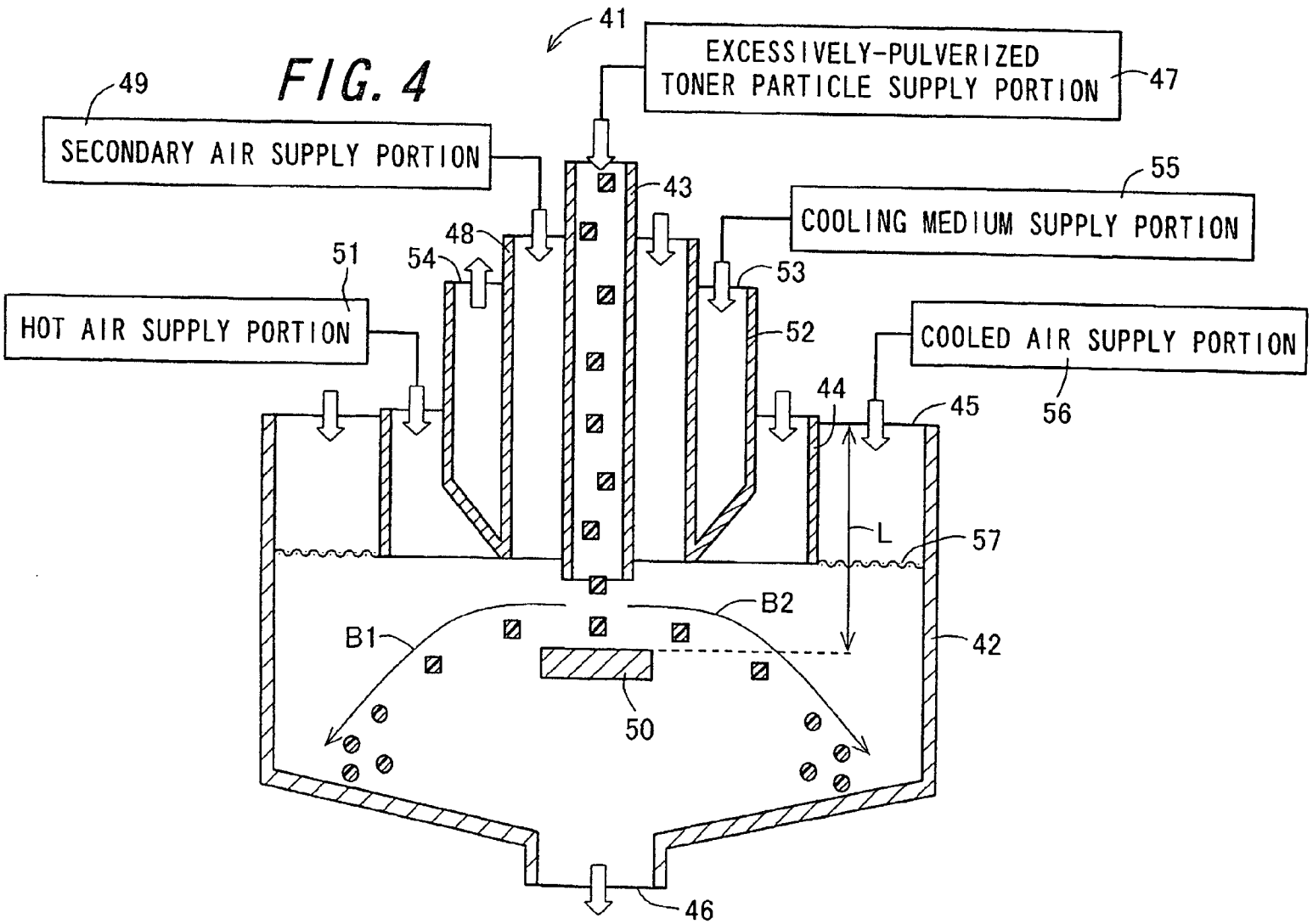
FIG. 4 is a sectional view schematically showing a configuration of a hot-air-type spheronizing device.

Hereinbelow, descriptions will be given to the method of forming the excessively-pulverized toner particles into spherical shapes by use of hot air. FIG. 4 is a sectional view schematically showing a configuration of a hot-air-type spheronizing device 41. The hot-air-type spheronizing device 41 uses hot air to form the excessively-pulverized toner particles into spherical shapes. The hot-air-type spheronizing device 41 includes a treatment tank 42, a dispersing nozzle 43, a hot-air injecting nozzle 44, and a cooled air inlet 45. Note that the sectional view of the hot-air-type spheronizing device 41 shows a view in a state where the dispersing nozzle 43 and the vicinity thereof have been sectioned by a plane extending in parallel with a direction in which the dispersing nozzle 43 extends and where the treatment tank 42 has been sectioned by a plane extending in parallel with an axis line of the treatment tank 42.

The treatment tank 42 is a substantially cylindrical treatment container which is tapered with a bottom surface at a lower position in an axial direction thereof being smaller in diameter. The treatment tank 42 is disposed so that the axial direction substantially corresponds to a vertical direction. The treatment tank 42 has on an upper part thereof the dispersing nozzle 43 and the hot-air injecting nozzle 44, and on an outer peripheral part of the treatment tank 42 is formed the cooled air inlet 45. Moreover, in the bottom surface of the treatment tank 42 is formed an outlet 46 for discharging the excessively pulverized toner particles formed into spherical shapes, that is, the second toner particles.

The dispersing nozzle 43 is connected to an excessively-pulverized toner particle supply portion 47 for supplying a fixed amount of the excessively-pulverized toner particles, and injects the excessively-pulverized toner particles together with the air into the treatment tank 42. Although only one dispersing nozzle 43 according to the present embodiment is shown in FIG. 4, four dispersing nozzles 43 are actually provided at regular intervals in a circumferential direction of the treatment tank 42. Those dispersing nozzles 43 inject the excessively-pulverized toner particles in a direction which is inclined by 45° against the axial direction of the treatment tank 42 such that an injection port of the dispersing nozzle 43 is away from an axis of the treatment tank 42.

Around the dispersing nozzle 43 is disposed a secondary air injecting nozzle 48. The secondary air injecting nozzle 48 injects the air which is supplied by a secondary air supply portion 49 composed of a pump etc., toward a collision member 50 disposed inside the treatment tank 42. The air injected from the secondary air injecting nozzle 48 may be air which is not heated or cooled. The excessively-pulverized toner particles injected from the dispersing nozzle 43 are directed to the collision member 50 disposed inside the treatment tank 42 by the air injected from the secondary air injecting nozzle 48.

The collision member 50 disposed inside the treatment tank 42 is a dispersing board for dispersing through collision the excessively-pulverized toner particles injected from the injecting nozzle 43. The collision member 50 may be, for example, a circular plate member. A shape of the collision member 50 is, however, not limited to the above-stated shape and may be, for example, a conical shape or circular truncated cone whose upper end is pointed, a conical shape whose upper and lower ends are both pointed, and the like shape.

The hot-air injecting nozzle 44 is provided around the dispersing nozzle 43 and the secondary air injecting nozzle 48. The hot-air injecting nozzle 44 is connected to a hot air supply portion 51 for supplying the air heated by a heating portion such as a heater, and thereby injects the hot air to the treatment tank 42. A mixture of the excessively-pulverized toner particles and the hot air flows in arrow B1 and B2 directions inside the treatment tank 42.

A temperature of the hot air injected by the hot-air injecting nozzle 44 is determined in accordance with an average degree of circularity of intended second toner particles. In manufacturing the toner of the invention, the temperature of the hot air is preferably a temperature which is higher than a glass transition temperature of the binder resin by 100° C. to 170° C., that is, a temperature of the glass transition temperature of the binder resin +100° C. or higher and the glass transition temperature of the hinder resin +170° C. or lower. The injection of the hot air having such a temperature can efficiently form the excessively-pulverized toner particles into preferred shape.

However, when an external additive which will be described later on is attached to the excessively-pulverized toner particles, the temperature of the hot air can be higher than the glass transition temperature of the hinder resin +170° C. The pre-attachment of the external additive prior to the spheronization process can prevent the excessively-pulverized toner particles from being aggregated and increase the temperature of the hot air. In the case of pre-attaching of the external additive prior to the spheronization process, it is preferable that the maximum temperature of the hot air is the glass transition temperature of the binder resin +220° C. When the temperature of the hot air exceeds this maximum value, the second toner particles turn out to be substantially perfect spheres even if the external additive is attached to the excessively-pulverized toner particles. This causes a decrease in the cleaning property when the excessively-pulverized toner particles are used as a toner.

On an outer periphery of the secondary air injecting nozzle 48 is provided a cooling jacket 52 for preventing the temperature of the dispersing nozzle 43 from rising up to a temperature equal to or higher than the softening temperature of the binder resin contained in the excessively-pulverized toner particles. The above-mentioned rise in the temperature of dispersing nozzle 43 is caused by contact between the dispersing nozzle 43 and the hot air flowing inside the hot-air injecting nozzle 44. The cooling jacket 52 has a cooling medium inlet 53 and a cooling medium outlet 54. The cooling medium inlet 53 is connected to a cooling medium supply portion 55. A cooling medium is supplied from the cooling medium supply portion 55 to the cooling jacket 52 via the cooling medium inlet 53, thereby to cool down the secondary air injecting nozzle 48 and the dispersing nozzle 43. The cooling medium used for the cooling then outflows from the cooling medium outlet 54. Examples of the cooling medium include water, air, and gas other than the air, which have been cooled down by a cooling device to a temperature equal to or lower than 10° C.

The cooled air inlet 45 is used to let the cooled air supplied by a cooled air supply portion 56 flow into the treatment tank 42. The cooled air inlet 45 is connected to the cooled air supply portion 56 so that the cooled air generated in the device is led into the treatment tank 42. The cooled air inlet 45 is provided with a filter 57. A distance L between the cooled air inlet 45, and a surface of collision member 50 facing the dispersing nozzle 43 (hereinafter referred to as "distance L between the cooled air inlet 45 and the collision member 50" simply) can be preferably determined in accordance with the size of the treatment tank 42, a treatment amount of the excessively-pulverized toner particles per unit time, and the like element. For example, when an inner diameter of the treatment tank 42 is 3 cm and the treatment amount of the excessively-pulverized toner particles is 3 kg per hour, the distance L between the cooled air inlet 45 and the collision member 50 is preferably 1 cm or more and 2.5 cm or less. When being less than 1 cm, the distance L between the cooled air inlet 45 and the collision member 50 is too short. This results in a failure to carry out the spheronization process of the excessively-pulverized toner particles. On the other hand, when exceeding 2.5 cm, the distance L between the cooled air inlet 45 and the collision member 50 is too long. This results in an excessive increase in the average degree of circularity of the second toner particles obtained by forming the excessively-pulverized toner particles into spherical shapes.

The hot-air-type spheronizing device 41 having the configuration as described above forms the excessively-pulverized toner particles into spherical shapes as follows. First of all, the hot air is injected from the hot-air injecting nozzle 44 into the treatment tank 42 and at the same time, the cooling medium is made to flow inside the cooling jacket 52. Subsequently, solid-gas mixed fluid of the excessively-pulverized toner particles and the air is injected from the dispersing nozzle 43.

When the excessively-pulverized toner particles are injected from the dispersing nozzle 43, the excessively-pulverized toner particles collide with the collision member 50. Since the excessively-pulverized toner particles are dispersed by the collision with the collision member 50 and the air injected from the secondary air injecting nozzle 48, the excessively-pulverized toner particles are supplied into the hot air in a state where the excessively-pulverized toner particles are not in contact with each other. A temperature of the hot air is so high as the temperature which is higher than the glass transition temperature of the binder resin by 100° C. to 170° C. The surfaces of the excessively-pulverized toner particles are molten in such a high temperature region, thus resulting in spheronization of the excessively-pulverized toner particles.

When the surfaces of the excessively-pulverized toner particles are molten to thereby result in spheronization of the excessively-pulverized toner particles, the cooled air flows from the cooled air inlet 45 into the treatment tank 42. The excessively-pulverized toner particles which have been treated with the spheronization process are cooled down by the cooled air and thus solidified. Further, an inner wall of the treatment tank 42 is also cooled down by the cooled air inflowing from the cooled air inlet 45 and therefore, the excessively-pulverized toner particles which have been treated with the spheronization process are not attached to the inner wall of the treatment tank 42 and are discharged from the outlet 46 formed in a lower part of the treatment tank 42.

As described above, the excessively-pulverized toner particles are formed into spherical shapes. In the hot-air-type spheronizing device 41, the molten excessively-pulverized toner particles are prevented from coming into contact with each other and therefore, there is no difference between the volume average particle size of the excessively-pulverized toner particles which have not yet been treated with the spheronization process and the volume average particle size of the excessively-pulverized toner particles which have already been treated with the spheronization process, i.e. the second toner particles. The spheronization process is thus performed without fusion of excessively-pulverized toner particles. Further, in the hot-air-type spheronizing device 41 as described above, the spheronization process can be performed by appropriately setting conditions under which the small-size toner particles having a volume average particle size of 1 μm or more and 4 μm or less form into favorable shapes, since particles having small surface areas among the excessively-pulverized toner particles are easily treated with the spheronization process. The conditions for making the small-size particles form into favorable shapes are, for example, a temperature and supply amount of the hot air, a temperature and supply amount of the cooled air, a position where the cooled air inlet 45 is formed, and the like element.

Further, the hot-air-type spheronizing device 41 has a very simple configuration and a compact size. Moreover, in the hot-air-type spheronizing device 41, the temperature rise of the inner wall of the treatment tank 42 is inhibited, thus resulting in a high product yield. Furthermore, the hot-air-type spheronizing device 41 having the configuration as described above is open-typed, which leads to almost no possibility of dust explosion and allows an immediate treatment with the hot air. As a result, the excessively-pulverized toner particles are not aggregated, and the entire excessively-pulverized toner particles are uniformly treated.

For the hot-air-type spheronizing device 41 as described above, commercially-available devices are also usable including, for example, a surface-modifying machine: METEORAINBOW (trade name) manufactured by Nippon Pneumatic MFG. Co., Ltd.

As described above, in the spheronizing step, it is preferable to manufacture the second toner particles by forming the excessively-pulverized toner particles into spherical shapes with the aid of mechanical impact or hot air. In this way, it is possible to easily cause the average degree of circularity and the circularity degree distribution of the second toner particles to fall in favorable ranges. This makes it possible to easily manufacture a toner which has a good cleaning property and exhibits high-level flowability and transfer efficiency, and by using which a high-quality image of high definition and resolution can be formed.

Further, the volume average particle size of the second toner particles produced in the spheronizing step is preferably 3 μm or more and 5 μm or less. In this way, it is possible to cause more easily the content of the fine toner particles having a volume average particle size of 4 μm or less in the toner to fall in a preferred range. This makes it possible to manufacture more easily a toner capable of being used to form a high-quality image of high definition and resolution. When the volume average particle size of the second toner particles is less than 3 μm, it is difficult to perform classification, thereby causing difficulty in manufacturing the toner. On the other hand, when the volume average particle size of the second toner particles exceeds 5 μm, the content of the fine toner particles is too low in the toner, thereby causing a failure to obtain a high-quality image.

[Mixing Step]

In the mixing step of Step S6, the first toner particles and the second toner particles are mixed. In the mixing step, the second toner particles are preferably mixed with the first toner particles in a ratio of 3 parts by weight or more and 20 parts by weight or less on the basis of 100 parts by weight of the first toner particles. In this way, it is possible to cause more reliably the content of the fine toner particles having a volume average particle size of 4 μm or less contained in the toner to fall in a preferred range. Therefore, a toner can be manufactured by using which it is possible to form a high-quality image of high definition and resolution more reliably. When the content of the second toner particles is less than 3 parts by weight, the content of the fine toner particles is insufficient, thereby causing a failure to obtain a high-quality image sufficiently improved in definition and resolution. On the other hand, when the content of the second toner particles exceeds 20 parts by weight, the content of the fine toner particles is excessive. This thereby leads to a decline in flowability, to occurrence of fogs caused by toner spattering and poor transfer efficiency, and to deterioration in cleaning property.

In mixing the first toner particles and the second toner particles in the mixing step, an external additive may be mixed which bears the functions of, for example, enhancing particle flowability, enhancing frictional charging property, enhancing heat resistance, improving long-term conservation, improving cleaning property, and controlling wear characteristics of photoreceptor surfaces. Examples of the external additive include fine particles of silica, fine particles of titanium oxide, and fine particles of alumina. The external additives may be used each alone, or two or more of the external additives may be used in combination. An additive amount of the external additive is preferably 2 parts by weight or less on the basis of 100 parts by weight of the toner particles, considering a charge amount necessary for the toner, influence on wear of the photoreceptor caused by addition of the external additive, environmental characteristics of the toner, and the like element.

It is preferable that the external additive as described above is externally added to excessively-pulverized toner particles which have not been yet treated with the spheronization process, in a case where the hot-air-type spheronizing device is used and a temperature of hot air thereof is higher than the glass transition temperature of the binder resin +170° C. When the external additive is attached to the excessively-pulverized toner particles having not been treated with the spheronization process, it can be prevented from occurring that rapid softening of surfaces of the excessively-pulverized toner particles owing to the high-temperature hot air leads to aggregation of the excessively-pulverized toner particles and thus to coarsening of the toner particles. The attachment of the external additive to the excessively-pulverized toner particles having not been treated with the spheronization process may be performed in a case where the temperature of the hot air is equal to or less than the glass transition temperature of the binder resin +170° C. However, in this case, a prolonged period of time may be needed to perform the spheronization process of the excessively-pulverized toner particles. Therefore, the addition of the external additive is preferably performed in accordance with the temperature of the hot air and materials used as toner raw materials such as a binder resin.

Upon the completion of the mixing step, the procedure proceeds from Step S6 to Step S7 and the manufacturing of the toner comes to an end.

The toner manufactured in the manner as described above can be directly used in form of a one-component developer alone or can be mixed with a carrier to be used in form of a two-component developer.

As the carrier, magnetic particles can be used. Specific examples of the magnetic particles include metals such as iron, ferrite, and magnetite; and alloys of the metals just cited and metals such as aluminum or lead. Among these examples, ferrite is preferred.

Further, the carrier can be a resin-coated carrier in which the magnetic particles are coated with resin, or a dispersed-in-resin carrier in which the magnetic particles are dispersed in resin. The resin with which the magnetic particles is coated is not particularly limited and includes. For example, olefin-based resin, styrene-based resin, styreneacrylic resin, silicone-based resin, ester-based resin, and fluorine-containing polymer-based resin, for example. The resin used for the dispersed-in-resin carrier is also not particularly limited and includes styrene acrylic resin, polyester resin, fluorine-based resin, and phenol resin, for example.

A shape of the carrier is preferably to be spherical or flat. A volume average particle size of the carrier is, although not particularly limited, preferably 30 μm or more and 50 μm or less in consideration of formation of higher-quality images. Furthermore, a resistivity of the carrier is preferably $10^8$ Ω·cm or more, and more preferably $10^{12}$ Ω·cm or more. The resistivity of the carrier is determined in a manner that the carrier is put in a container having a sectional area of 0.50 $cm^2$ followed by tapping, and a load of 1 $kg/cm^2$ is then applied to the particles put in the container, thereafter reading a current value upon application of voltage which generates an electric field of 1,000 V/cm between the load and a bottom electrode. When the resistivity is low, application of bias voltage to a developing sleeve will cause charges to be injected to the carrier, which makes the carrier particles be easily attached to the photoreceptor. Further, in this case, breakdown of the bias voltage occurs more easily.

A magnetization intensity (maximum magnetization) of the carrier is preferably from 10 emu/g to 60 emu/g, and more preferably from 15 emu/g to 40 emu/g. The magnetization intensity depends on magnetic flux density of a developing roller. Under a condition that the developing roller has normal magnetic flux density, the magnetization intensity less than 10 emu/g will lead to a failure to exercise magnetic binding force, which may cause the carrier to be spattered. When the magnetization intensity exceeds 60 emu/g, it becomes difficult to keep a non-contact state with an image bearing member in a non-contact phenomenon where brush of the carrier is too high. Further, in a contact phenomenon, sweeping patterns may appear more frequently in a toner image.

A use ratio between the toner and the carrier contained in the two-component developer may be appropriately selected according to types of the toner and carrier without particular limitation. To take the case of the ferrite carrier as an example, it is only required that the use amount of the toner contained in the developer is 2% by weight or more and 30% by weight or less and preferably 2% by weight or more and 20% by weight or less based on a total amount of the developer. In the two-component developer, a coverage of the toner over the carrier is preferably 40% or higher and 80% or lower.

The two-component developer of the invention contains a carrier, and the toner which has been controlled in respect of the particle size distribution and of the average degree of circularity and the circularity degree distribution of the toner particles having a volume average particle size of 1 μm or more and 4 μm or less. This allows the two-component developer to have a good cleaning property and exhibit high-level flowability and transfer efficiency. Further, a high-quality image of high definition and resolution can be formed by using the two-component developer.

Figure 5:
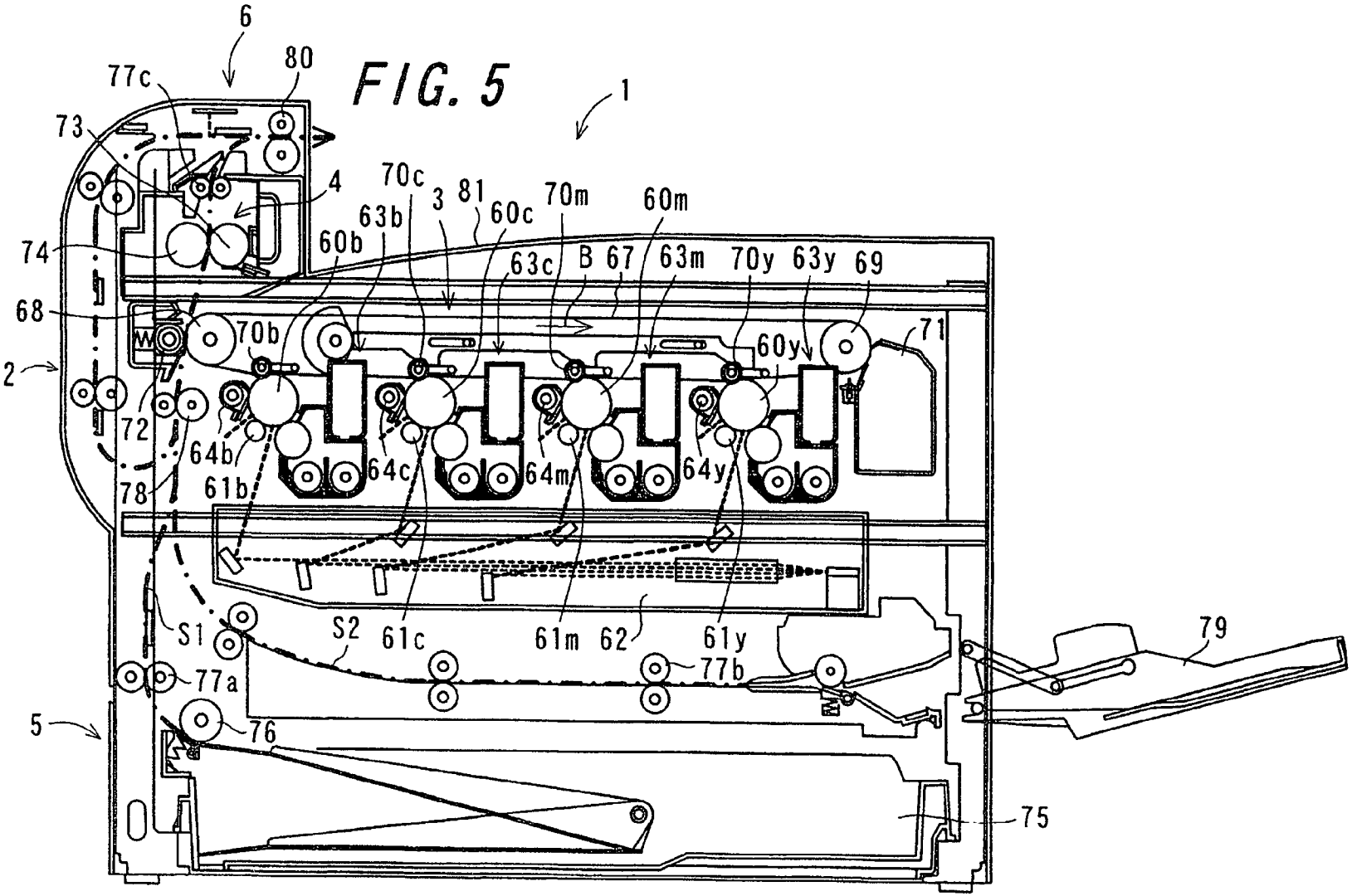
FIG. 5 is a sectional view schematically showing an example of a configuration of an image forming apparatus suitable to use the toner of the invention.

FIG. 5 is a sectional view schematically showing an example of a configuration of an image forming apparatus 1 suitable to use the toner of the invention. The image forming apparatus 1 is a multifunction printer having a copy function, a print function, and a facsimile function, and forms a Full-color or monochrome image on a recording medium in accordance with transmitted image information. That is, the image forming apparatus 1 has three types of printing modes, namely a copy mode, a print mode, and a fax mode. The printing modes can be selected by a control portion (not shown) in accordance with an operation input from an operation portion (not shown), reception of a print job from a personal computer, a mobile terminal apparatus, an information recording and storing medium, an external apparatus using a memory device, and the like. As shown in FIG. 5, the image forming apparatus 1 includes a toner image forming section 2, a transfer section 3, a fixing section 4, a recording medium feeding section 5, and a discharging section 6. Members constituting the toner image forming section 2 and a part of members included the transfer section 3 are each disposed in the number of four in order to correspond to image information of respective colors of black (b), cyan (c), magenta (m), and yellow (c) contained in color image information. Here, the respective members disposed in the number of 4 to correspond to the respective colors are distinguished by adding alphabets representing the respective colors as suffixes of reference numerals thereof, and are represented only by the reference numerals in case of being collectively called.

The toner image forming section 2 includes a photoreceptor drum 60, a charging portion 61, an exposing unit 62, a developing device 63, and a cleaning unit 64. The charging portion 61, the developing device 63, and the cleaning unit 64 are sequentially disposed around the photoreceptor drum 60 in this order. The charging portion 61 is disposed lower than the developing device 63 and the cleaning unit 64 when viewed in a vertical direction thereof.

The photoreceptor drum 60 is supported and so driven to be rotate about an axis thereof by a drive mechanism (not shown). The photoreceptor drum 60 is composed of a conductive substrate (not shown) and a photosensitive layer (not shown) formed on a surface of the conductive substrate. The conductive substrate can be set to have a variety of shapes, for example, a cylindrical shape, a columnar shape, or a film-sheet shape. Among these shapes, the cylindrical shape is preferred. The conductive substrate is formed of an electrically-conductive material. As the electrically-conductive material, usable are materials commonly-used in this field, for example, metals such as aluminum, copper, brass, zinc, nickel, stainless steel, chromium, molybdenum, vanadium, indium, titanium, gold, and platinum; an alloy of two or more of the metals just cited; an electrically-conductive film obtained by forming an electrically-conductive layer composed of one or two or more of aluminum, aluminum alloy, tin oxide, gold, indium oxide, and so forth, on a film-like substrate such as synthetic resin film, metallic film, paper; and a resin composition at least containing either electrically-conductive particles or electrically-conductive polymer; and so forth. Note that, as the film-like substrate used for the electrically-conductive film, the synthetic resin film is preferred and polyester film is particularly preferred. Further, deposition, coating, and so on are preferred as a method of forming an electrically-conductive layer of the electrically-conductive film.

The photosensitive layer is formed by, for example, lamination of a charge generating layer containing a charge generating substance and a charge transporting layer containing a charge transporting substance. In this time, an undercoat layer is preferably designed between the conductive substrate and the charge generating layer or the charge transporting layer. The design of the undercoat layer leads to an advantage of smoothing a surface of the photosensitive layer by coating of flaws and irregularities existent on the surface of the conductive substrate, an advantage of preventing charging property of the photosensitive layer from deteriorating when being repeatedly used, and an advantage of improving the charging property of the photosensitive layer at least either in a low-temperature environment or a low-humidity environment. Further, the photosensitive layer may be a three-layer photosensitive layer which is excellent in durability and in which a protective layer for protecting the surface of the photosensitive layer is disposed as a topmost layer.

The charge generating layer has the charge generating substance for generating charge by light irradiation as a main component, and may contain a known binder resin, plasticizer, sensitizer, etc. according to need. As the charge generating substance, usable are substances commonly-used in this field. Examples of the usable charge generating substance include perylene pigments such as peryleneimide and perylene acid anhydride; polycyclic quinine pigments such as quinacridone and anthraquinone; phthalocyanine pigments such as metallic phthalocyanine and metal-free phthalocyanine, and halogenated metal-free phthalocyanine; squarium pigments; azulenium pigments; thipyrylium pigments; azo pigments having a carbazole skeleton, a styrylstilbene skeleton, a triphenylamine skeleton, a dibenzothiophene skeleton, an oxadiazole skeleton, a fluorenone skeleton, a bisstilbene skeleton, a distyryloxadiazole skeleton, or a distyrylcarbazole skeleton. Among the pigments just cited, pigments which are high in charge generating ability and are suitable for obtaining a high-sensitivity photosensitive layer, are the metal-free phthalocyanine pigments, oxotitanylphthalocyanine pigments, bisazo pigments at least containing either a fluorene ring or a fluorenone ring, bisazo pigments composed of aromatic amine, trisazo pigments, and the like pigments. The charge generating substances may be used each alone, or two or more of the charge generating substances may be used in combination. A content of the charge generating substance is, although not particularly limited, preferably in a range of from 5 parts by weight to 500 parts by weight, and more preferably from 10 parts by weight to 200 parts by weight, on the basis of 100 parts by weight of the binder resin contained in the charge generating layer. As the binder resin for the charge generating layer, usable are binder resins commonly-used in this field, for example, melamine resin, epoxy resin, silicone resin, polyurethane, acrylic resin, vinyl chloride-vinyl acetate copolymer resin, polycarbonate, phenoxy resin, polyvinyl butyral, polyarylate, polyamide, and polyester. The binder resins just cited may be used each alone, or two or more of the binder resins may be used in combination according to need.

Together with the plasticizer, sensitizer, and the like if needed, the charge generating substance and the binder resin are dissolved or dispersed in moderate quantities into an appropriate organic solvent capable of dissolving or dispersing the just-mentioned components, so as to prepare an applying fluid for the charge generating layer. The charge generating layer can be formed by application of the applying fluid for the charge generating layer to the surface of the conductive substrate and subsequent drying of the conductive substrate. A film thickness of the charge generating layer as obtained above is, although not particularly limited, preferably in a range of from 0.05 μm to 5 μm, and more preferably from 0.1 μm to 2.5 μm.

The charge transporting layer laminated on the charge generating layer has the charge transporting substance and a binder resin for the charge transporting layer as essential components, and may contain a known antioxidant, plasticizer, sensitizer, lubricant, and so forth according to need. The charge transporting substance is capable of receiving and transporting charges generated from the charge generating substance. As the charge transporting substance, usable are substances commonly-used in this field. Examples of the charge transporting substance include electron-donating substances such as poly-N-vinylcarbazole and its derivatives, poly-y-carbazolylethylglutamate and its derivatives, pyrene-formaldehyde condensate and its derivatives, polyvinylpyrene, polyvinylphenanthrene, oxazole derivatives, oxadiazolyl derivatives, imidazole derivatives, 9-(p-diethylaminostyril)anthracene, 1,1-bis(4-dibenzylaminophenyl)propane, styrylanthracene, styrylpyrazoline, pyrazoline derivatives, phenylhydrazones, hydrazone derivatives, triphenylamine compounds, tetraphenyldiamine compounds, triphenylmethane compounds, stilbene compounds, azine compounds having a 3-methyl-2-benzothiazolene ring; and electron-accepting substances such as fluorenone derivatives, dibenzothiophene derivatives, indenothiophene derivatives, phenanthrenquinone derivatives, indenopyridine derivatives, thioxanthone derivatives, benzo[c]cinnoline derivatives, phenazineoxide derivatives, tetracyancethylene, tetracyanoquinodimethane, promanyl, chloranyl, benzoquinone. The charge transporting substances just cited may be used each alone, or two or more of the charge transporting substances may be used in combination. A content of the charge transporting substance is, although not particularly limited, preferably in a range of from 10 parts by weight to 300 parts by weight and more preferably from 30 parts by weight to 150 parts by weight, on the basis of 100 parts by weight of the binder resin contained in the charge transporting layer. As the binder resin for the charge transporting layer, usable are binder resins which are commonly-used in this field and capable of uniformly dispersing the charge transporting substance. Examples of the binder resin include polycarbonate, polyallyrate, polyvinyl butyral, polyamide, polyester, polyketone, epoxy resin, polyurethane, polyvinylketone, polystyrene, polyacrylamide, phenol resin, phenoxy resin, polysulfone resin, and copolymer resin of these resins just cited. Considering film-forming property, resistance to abrasion of the charge transporting layer to be obtained, electrical property, and the like property, among these resins are preferred polycarbonate containing bisphenol Z as a monomer component (hereinafter, referred to as "bisphenol-Z polycarbonate") and a mixture of bisphenol-Z polycarbonate and other polycarbonates. The binder resins just cited may be used each alone, or two or more of the binder resins may be used in combination.

In addition to the charge transporting substance and the binder resin for the charge transporting layer, the charge transporting layer preferably contains an antioxidant. As the antioxidant, usable are antioxidants commonly-used in this field, for example, vitamin E, hydroquinone, hindered amine, hindered phenol, para-phenylenediamine, arylalkane, derivatives of these antioxidants just cited, organosulfur compounds, phosphororganic compounds, and so forth. The antioxidants just cited may be used each alone, or two or more of the antioxidants may be used in combination. A content of the antioxidant is, although not particularly limited, preferably in a range of from 0.01% by weight to 10% by weight and more preferably from 0.05% by weight to 5% by weight, on the basis of a sum amount of components constituting the charge transporting layer. Together with the antioxidant, a plasticizer, a sensitizer, and so forth if needed, the charge transporting substance and the binder resin are dissolved or dispersed in moderate quantities into an appropriate organic solvent capable of dissolving or dispersing the just-mentioned components, so as to prepare an applying fluid for the charge transporting layer. The charge transporting layer can be formed by application of the applying fluid for the charge transporting layer to a surface of the charge generating layer and subsequent drying the charge generating layer. A film thickness of the charge transporting layer obtained as described above is, although not particularly limited, preferably in a range of from 10 μm to 50 μm, and more preferably from 15 μm to 40 μm. Note that it is possible to form a photosensitive layer in which a charge generating substance and a charge transporting substance are coexistent in one layer. In this case, types and contents of the charge generating substance and the charge transporting substance, types of binder resin, other external additives, etc., may be the same as those used in the case of respectively forming the charge generating layer and the charge transporting layer.

In this embodiment, used is the above-described photoreceptor drum 60 where an organic photosensitive layer is formed by using the charge generating substance and the charge transporting substance. However, as a substitute for the photoreceptor drum 60, it is possible to use a photoreceptor drum where an inorganic photosensitive layer is formed by using silicon or the like.

The charging portion 61 is so disposed as to face the photoreceptor drum 60 and separate from the surface of the photoreceptor drum 60 with a gap secured therebetween when viewed along a longitudinal direction of the photoreceptor drum 60. The charging portion 61 charges the surface of the photoreceptor 60 with a predetermined polarity and a predetermined electrical potential. As the charging portion 61, usable are a charging brush-type charging device, a charger-type charging device, a pin array charging device, an ion-generating device, or the like device. In the present embodiment, the charging portion 61 is so disposed as to be separated from the surface of the photoreceptor drum 60. However, the charging portion 61 and the photoreceptor drum 60 can also be disposed in other manner. For example, a charging roller used as the charging portion 61 may be so disposed as to the in pressure-contact with the photoreceptor drum 60. Further, it is also possible to use a contact-charging charger such as a charging brush and a magnetic brush.

The exposing unit 62 is so disposed that light beams corresponding to information of the respective colors emitted from the exposing unit 62 pass between the charging portion 61 and the developing device 63 and irradiate the surface of the photoreceptor drum 60. The exposing unit 62 converts image information into light beams corresponding to information of the respective colors of black (b), cyan (c), magenta (m), and yellow (y), and exposes the surface of the photoreceptor drum 60 uniformly-charged by the charging portion 61, to the light beams corresponding to information of the respective colors. An electrostatic latent image is thus formed on the surface of the photoreceptor drum 60. As the exposing unit 62, usable is, for example, a laser scanning unit having a laser irradiating portion and plural reflecting mirrors. In addition, there may be used an LED array, and a unit where a liquid-crystal shutter and a light source have been appropriately combined.

Figure 6:
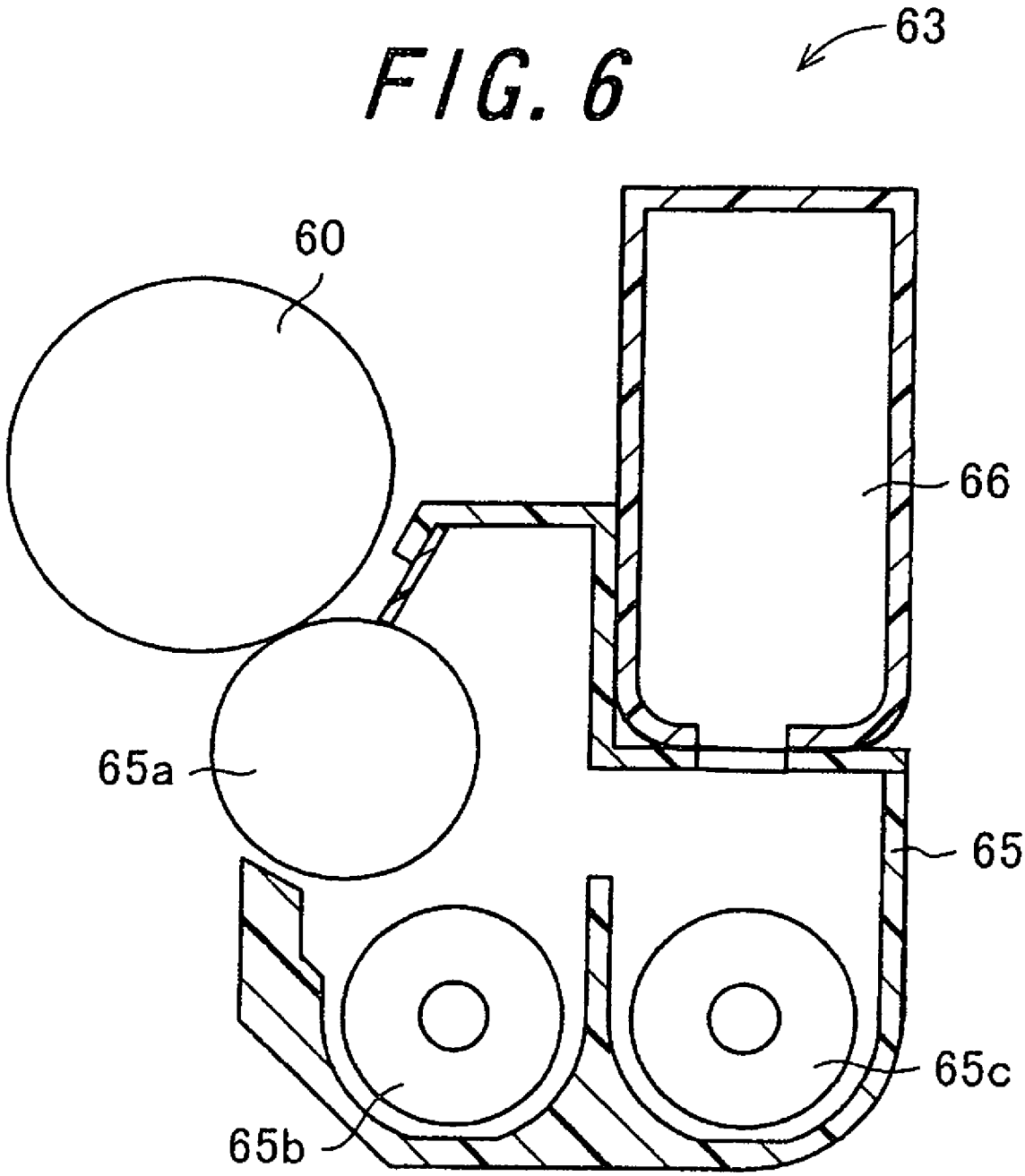
FIG. 6 is a sectional view schematically showing an example of a configuration of a developing device.

FIG. 6 is a sectional view schematically showing an example of a configuration of the developing device 63. The developing device 63 includes, as shown in FIG. 6, a developing tank 65 and a toner hopper 66. The developing tank 65 which is so disposed as to face the surface of the photoreceptor drum 60 is a container-like member for feeding the toner to the electrostatic latent image formed on the surface of the photoreceptor drum 60 so that a visible toner image is formed thereon. The developing tank 65 houses the toner therein. In addition, the developing tank 65 houses and rotatably supports roller-like members such as a developing roller 65*a*, a feeding roller 65*b* and a stirring roller 65*c*; or screw-like members therein. The developing tank 65 has an opening port formed in its side surface facing the photoreceptor drum 60. The developing roller 65*a* is rotatably disposed at a position facing the photoreceptor drum 60 via the opening port. The developing roller 65*a* is a roller-like member for feeding the toner to the surface of the photoreceptor drum 60 in a pressure-contact part or a proximal part located between the photoreceptor drum 60 and the developing roller 65*a*. In feeding the toner, an electrical potential opposite to a charged potential of the toner is applied as a developing bias voltage (hereinafter, referred to as "developing bias") to a surface of the developing roller 65*a*. By doing so, the toner on the surface of the developing roller 65*a* is smoothly fed to the electrostatic latent image. Further, a change in a value of the developing bias makes it possible to control an amount of toner fed to the electrostatic latent image (an adhesion amount of toner). The feeding roller 65*b* is a roller-like member rotatably disposed to face the developing roller 65*a* and feeds the toner to the vicinity of the developing roller 65*a*. The stirring roller 65*c* is a roller-like member rotatably disposed to face the feeding roller 65*b* and delivers to the vicinity of the feeding roller 65*b* a toner newly-fed into the developing tank 65 from the toner hopper 66. The toner hopper 66 is so disposed that a toner replenishment port (not shown) provided in a bottom of the toner hopper 66 when viewed in a vertical direction thereof is in communication with a toner receiving port (not shown) provided in the top of the developing tank 65 when viewed in a vertical direction thereof. The toner hopper 66 replenishes the toner in accordance with a toner assumption situation in the developing tank 65. In addition, a design may be used where the toner hopper 66 is not disposed and the Loner is directly replenished from toner cartridges of the respective colors.

The developing device 63 according to the invention performs development by using the two-component developer containing a carrier, and the toner which has been controlled in respect of the particle size distribution and of the average degree of circularity and the circularity degree distribution of the toner particles having a volume average particle size of 1 μm or more and 4 μm or less. This allows a toner image high in definition and resolution to be formed on the photoreceptor drum 60.

The cleaning unit 64 removes the toner remaining left on the surface of the photoreceptor drum 60 and cleans the surface of the photoreceptor drum 60 after the toner image has been transferred to the recording medium. As the cleaning unit 64, usable is a plate-like member such as a cleaning blade, for example. Note that deterioration in surface easily occurs due to a chemical action of ozone resulted from corona discharge of the charging portion 61, since an organic photoreceptor drum is mainly used as the photoreceptor drum 60 in the image forming apparatus 1 of the invention and the surface of the organic photoreceptor drum is mainly composed of resin. However, the deteriorated part of the surface can be worn by an abrading behavior of the cleaning unit 64 and is slowly but reliably removed. Accordingly, the problem of the surface deterioration caused by the ozone or the like can be actually resolved, and the charged potential charged by a charging operation can be stably maintained for a prolonged period of time. While the cleaning unit 64 is disposed in the embodiment, the cleaning unit 64 is not indispensable.

In the toner image forming section 2, the image-information-based signal lights are irradiated from the exposing unit 62 onto the surface of the photoreceptor drum 60 uniformly-charged by the charging portion 61 so that the electrostatic latent image is formed thereon, and the toner is thereafter fed from the developing device 63 to the electrostatic latent image to form a toner image which is then transferred to an intermediary transfer belt 67. And then, the toner remaining left on the surface of the photoreceptor drum 60 is removed by the cleaning unit 64. This series of toner-forming operations as described above are repeatedly carried out.

The transfer section 3 is disposed above the photoreceptor drum 60 and includes the intermediary transfer belt 67, a driving roller 68, a driven roller 69, intermediary transfer rollers 70*b*, 70*c*, 70*m*, 70*y*, a transfer belt cleaning unit 71, and a transfer roller 72. The intermediary transfer belt 67 is an endless belt-like member which is stretched between the driving roller 68 and the driven roller 69 to form a loop movement path. The intermediary transfer belt 67 is rotated to move in an arrow B direction, namely in a direction in which that surface of intermediary transfer belt 67 being in contact with the photoreceptor drum 60 moves from the photoreceptor drum 60*y* toward the photoreceptor drum 60*b*.

When the intermediary transfer belt 67 passes the photoreceptor drum 60 while keeping in contact therewith, a transfer bias having a polarity opposite to that of the charged toner located on the surface of the photoreceptor drum 60 is applied to the intermediary transfer belt 67, from the intermediary transfer roller 70 which is so disposed as to face the photoreceptor drum 60 with the intermediary transfer belt 67 sandwiched therebetween. And then, the toner image formed on the surface of the photoreceptor drum 60 is transferred onto the intermediary transfer belt 67. In the case of a full-color image, the toner images of the respective colors formed by the respective photoreceptor drums 60*b*, 60*c*, 60*m*, 60*y* are sequentially transferred and overlaid onto the intermediary transfer belt 67. A full-color image is thus formed. The driving roller 68 can be driven to rotate about an axis thereof by a drive mechanism (not shown), and the rotation driving thereof drives the intermediary transfer belt 67 to rotate in the arrow B direction. The driven roller 69 can be rotated following the rotation driving of the driving roller 68 and applies a constant degree of tension to the intermediary transfer belt 67 so as to prevent the intermediary transfer belt 67 from becoming loose. The intermediary transfer roller 70 is kept in pressure-contact with the photoreceptor drum 60 via the intermediary transfer belt 67 and can be driven to rotate about an axis thereof by a drive mechanism (not shown). The intermediary transfer roller 70 is connected to a light source (not shown) for applying the transfer bias as described above and has a function of transferring the toner image on the surface of the photoreceptor drum 60 onto the intermediary transfer belt 67. The transfer belt cleaning unit 71 is so disposed as to face the driven roller 69 via the intermediary transfer belt 67 and keep in contact with an outer periphery of the intermediary transfer belt 67. The transfer belt cleaning unit 71 removes and collects the toner remaining left on the surface of the intermediary transfer belt 67, since pollution of a reverse side of the recording medium may be caused by the toner which adheres to the intermediary transfer belt 67 by contact with the photoreceptor drum 60 and remains left thereon without being transferred to the recording medium. The transfer roller 72 is so disposed as to be kept in pressure-contact with the driving roller 68 via the intermediary transfer belt 67 and can be driven to rotate about an axis thereof by a drive mechanism (not shown). In a region (a transfer nip portion) where the transfer roller 72 and the driving roller 68 make pressure-contact with each other, the toner image which is borne on the intermediary transfer belt 67 and conveyed to the transfer nip portion, is transferred onto the recording medium fed from the later-described recording medium feeding section 5. The recording medium bearing the toner image is fed to the fixing section 4. According to the transfer section 3, the toner image transferred onto the intermediary transfer belt 67 from the photoreceptor drum 60 in a pressure-contact region therebetween, is conveyed to the transfer nip portion by the rotation driving of intermediary transfer belt 67 applied in the arrow B direction. And then, the toner image thus conveyed is transferred onto the recording medium in the transfer nip portion.

The fixing section 4 is disposed in a downstream side of a conveying direction of the recording medium lower than the transfer section 3, and includes a fixing roller 73 and a pressurizing roller 74. The fixing roller 73 capable of being driven to rotate by a drive mechanism (not shown), heats and fuses the toner which constitutes an unfixed toner image borne onto the recording medium, thus to fix the toner onto the recording medium. A heating portion (not shown) is disposed inside the fixing roller 73. The heating portion heats the fixing roller 73 so that a temperature of a surface of the fixing roller 73 attains to a predetermined value (a heating temperature). As the heating portion, usable are, for example, a heater, a halogen lamp, and so forth. The heating portion is controlled by a fixing-condition control portion described later. A temperature detecting sensor is disposed in the surface vicinity of the fixing roller 73 to detect a surface temperature of the fixing roller 73. A detection result detected by the temperature detecting sensor is written in a memory portion of a control unit described later. The fixing-condition control portion controls operations of the heating portion on the basis of the detection result written in the memory portion. The pressurizing roller 74 is disposed to be in pressure-contact with the fixing roller 73 and is supported to be rotate following the rotation driving of the fixing roller 73. When the fixing roller 73 fuses and fixes the toner onto the recording medium, the pressurizing roller 74 assists the fixing of the toner image to the recording medium, by pressurizing the toner and the recording medium. A portion where the fixing roller 73 and the pressurizing roller 74 make pressure-contact with each other is referred to as a fixing nip portion. In the fixing section 4, when the recording medium on which the toner image has been transferred in the transfer section 3 is held between the fixing roller 73 and the pressurizing roller 74 and passes through the fixing nip portion, the toner image is pressed under heat onto the recording medium, thus causing the toner image to be fixed onto the recording medium and an image to be formed thereon.

The recording medium feeding section 5 includes an automatic paper feed tray 7S, a pickup roller 76, conveying rollers 77*a* and 77*b*, registration rollers 78, and a manual paper feed tray 79. The automatic paper feed tray 75 is disposed in a lower part of the image forming apparatus 1 when viewed in the vertical direction thereof and is a container-like member for storing the recording medium. As the recording medium, usable are plain paper, color copy paper, sheets for overhead projector, a postcard, and so forth. The pickup roller 76 takes out piece by piece the recording medium stored in the automatic paper feeding tray 75 and delivers the recording medium thus taken-out to a paper conveyance path S1. The conveying rollers 77*a* are a pair of roller-like members disposed to be in pressure-contact with each other, and convey the recording medium toward the registration rollers 78. The registration rollers 78 are a pair of roller-like members disposed to be in pressure-contact with each other. The registration rollers 78 feed the recording medium fed from the conveying rollers 77*a* to the transfer nip portion in synchronization with the conveying of the toner image borne on the intermediary transfer belt 67 to the transfer nip portion. The manual paper feed tray 79 is a device storing recording mediums which are different from the recording mediums stored in the automatic paper feed tray 75 and may have any size and which are to be taken into the image forming apparatus 1. The recording medium taken out by the manual paper feed tray 79 is made to pass through a paper conveyance path S2 by the conveying rollers 77*b* and be thereafter sent to the registration rollers 78. According to the recording medium feeding section 5, the recording medium fed piece by piece from the automatic paper feed tray 75 or the manual paper feed tray 79 is so fed to the transfer nip portion in synchronization with the conveying of the toner image borne on the intermediary transfer belt 67 to the transfer nip portion.

The discharging section 6 includes conveying rollers 77*c* and discharging rollers 80, and a catch tray 81. The conveying rollers 77*c* are disposed, when viewed in the paper-conveyance direction, in a downstream side lower than the fixing nip portion. The conveying rollers 77*c* convey the recording medium where the image has been fixed by the fixing section 4, toward the discharging rollers 80. The discharging rollers 80 discharge the recording medium where the image has been fixed, into the catch tray 81. The catch tray 81 is disposed in an upper part of the image forming apparatus when viewed in the vertical direction thereof, and stores the recording medium where the image has been fixed.

The image forming apparatus 1 includes the control unit (not shown). The control unit is, for example, internally disposed in an upper part of the image forming apparatus 1 and includes a memory portion, a computing portion, and a control portion. Into the memory portion of the control unit are inputted various setting values through an operation panel (not shown) which is disposed in an upper part of the image forming apparatus 1, detection results from sensors (not shown) etc. internally disposed in different parts of the image forming apparatus 1, image information from an external apparatus, and so forth. Further, programs for executing various functional elements are written in the memory portion. The various functional elements refer to, for example, a recording medium determining portion, an adherence-amount control portion, the fixing-condition control portion, and so forth. As for the memory portion, usable are components commonly-used in this field, for example, a read-only memory (ROM), a random access memory (RAM), a hard disk driver (HOD), and so forth. As the external apparatus, usable is an electrical/electronic apparatus which is capable of creating or acquiring the image information and is electrically connectable to the image forming apparatus 1. Examples of the external apparatus include a computer, a digital camera, a television receiver, a video recorder, a DVD (digital versatile disc) recorder, an HDDVD (high-definition digital versatile disc), a bru-ray disc recorder, a facsimile device, a mobile terminal device, and so forth. The computing portion takes out the various data (an image-forming command, a detection result, and image information, and so forth) written in the memory portion and programs for the various functional elements, so as to perform various determinations. The control portion sends a control signal to a corresponding device in accordance with a result determined by the computing portion, so as to perform an operation control. Both the control portion and the computing portion include a processing circuit achieved by a microcomputer, a microprocessor, and the like each having a central processing unit (CPU). The control unit includes a main power source in addition to the above-described processing circuit, and an electric power is supplied to both the control unit and different devices located inside the image forming apparatus 1.

The image forming apparatus 1 of the invention has the developing device 63 of the invention. This allows the image forming apparatus 1 to form a high-quality image of high definition and resolution by using the toner of the invention which has a good cleaning property and exhibits high-level flowability and transfer efficiency.

EXAMPLES

Hereinbelow, the invention is specifically described with reference to Examples and Comparative Examples. However, the invention is not limited thereto and various changes can be made without departing from the scope of the invention.

[Physical Value Measuring Method]

Each physical value in Examples and Comparative Examples was measured in a manner as described below.

[Glass Transition Temperature (Tg) of Binder Resin]

Using a differential scanning calorimeter (trade name: DSC220; manufactured by Seiko Electronics Inc.), 1 g of a sample was heated at a temperature of which increase rate was 10° C./min based on Japanese Industrial Standards (JIS) K7121-1987, thus obtaining a DSC curve. A straight line was drawn toward a low-temperature side extendedly from a base line on the high-temperature side of an endothermic peak corresponding to glass transition of the DSC curve which had been obtained as above. A tangent line was also drawn at a point where a gradient thereof was maximum against a curve extending from a rising part to a top of the peak. A temperature at an intersection of the straight line and the tangent line was determined as the glass transition temperature (Tg).

[Softening Temperature (Tm) of Binder Resin]

Using a device for evaluating flow characteristics (trade name: Flow tester CFT-100C; manufactured by Shimadzu Corporation), 1 g of a sample was heated at a temperature of which increase rate was 6° C./min, under load of 10 kgf/cm$^2$ ($9.8\times10^5$ Pa) so that the sample was pushed out of a die. A temperature of the sample at the time when a half of the sample had flowed out of the die was determined as the softening temperature of the binder resin. Note that the die was 1 mm in nozzle opening diameter and 1 mm in length.

[Melting Point of Release Agent]

Using the differential scanning calorimeter (trade name: DSC220; manufactured by Seiko Electronics Inc.), 1 g of a sample was heated from a temperature of 20° C. up to 200° C. at a temperature of which increase rate was 10° C./min, and then an operation of rapidly cooling down the sample from 200° C. to 20° C. was repeated twice, thus obtaining a DSC curve. A temperature obtained at a top of an endothermic peak which corresponds to the melting shown on the DSC curve obtained at the second operation, was determined as the melting temperature of the release agent.

[Volume Average Particle Size ($D_{50v}$) and Number Average Particle Sizes ($D_{50p}$, $D_{84p}$)]

Into 50 ml of an electrolyte ISOTON II (trade name) manufactured by Beckman Coulter, Inc., 20 mg of a sample and 1 ml of sodium alkyl ether sulfate (a disperser) were added and dispersed for three minutes at an ultrasonic frequency of 20 kHz by an ultrasonic disperser UH-50 (trade name) manufactured by SMT Co., Ltd, thus obtaining a specimen for measurement. Using a Coulter counter (trade name: Multisizer 3; manufactured by Beckman Coulter Inc.), particle size measurement of the specimen thus obtained was performed under a condition that an aperture diameter was 20 μm and number of particles for measurement was 50,000. A volume particle size distribution and a number particle size distribution were determined on the basis of the measurement result thus obtained. A volume average particle size ($D_{50v}$) and number average particle sizes ($D_{50p}$, $D_{84p}$) of these particles were thus calculated based on the just-mentioned particle size distributions. Further, a content of the particles having a volume average particle size of 1 μm or more and 4 μm or less was determined on the basis of the particle size distributions.

[Average Degree of Circularity]

First of all, a dispersion fluid was prepared by dispersing 5 mg of a toner into 10 ml of water in which about 0.1 mg of a surfactant had been dissolved, and the dispersion was irradiated for five minutes with ultrasound having a frequency of 20 kHz and an output of 50 W. Assuming that a concentration of Loner particles contained in the dispersion fluid was 5,000 to 20,000 pieces/μL, the degree of circularity was measured by the above-stated flow particle image analyzer FPIA-3000 (trade name) manufactured by Sysmex Corporation on the basis of the above formula (3). Further, on the basis of a measurement result of the degree of circularity thus obtained, an average degree of circularity was calculated in accordance with the simple method for estimation.

Example 1

Manufacture of Toner

[Premixing Step and Melt-Kneading Step]

A toner raw material was mixed for 10 minutes by a Henschel mixer (trade name: FM MIXER; manufactured by Mitsui Mining Co., Ltd.) The toner raw material contained, as indicated by combination ratios (part by weight), 100 parts by weight (83% by weight) of polyester which serves as a binder resin Tafton TTR-5 (trade name) manufactured by Kao Corporation, having a glass transition temperature (Tg) of 60° C. and a softening temperature (Tm) of 100° C.; 14.5 parts by weight (12% by weight) of master batch containing as a colorant 40% by weight of C.I. pigment red 57:1; 3.6 parts by weight (3% by weight) of carnauba wax which serves as a release agent (trade name: REFINED CARNAUBA WAX; manufactured by S. KATO & Co.), having a melting point of 83° C.; and 2.4 parts by weight (2% by weight) of alkyl salicylate metal salt which serves as a charge control agent (trade name: BONTRON E-84; manufactured by Orient Chemical Industries, Ltd.). The toner raw material thus obtained was melt-kneaded by a twin-screw extruder PCM-65 (trade name) manufactured by Ikegai Corporation, and is thereafter cooled down to room temperature and solidified. A resin composition was thus obtained.

[Pulverizing Step]

The resin composition thus obtained by the premixing step and the melt-kneading step was coarsely pulverized by using a cutting mill (trade name: VM-16; manufactured by Orient Co., Ltd.). Subsequently, the coarsely-pulverized material obtained by the coarse pulverization was finely pulverized by a fluidized bed jet pulverizer (trade name: COUNTER JET MILL; manufactured by Hosokawa Micron Corporation), thus obtaining a pulverized material of the resin composition.

[Classifying Step]

The pulverized material obtained by the pulverizing step was classified by using a rotary wind classifier manufactured by Hosokawa Micron Corporation, and excessively-pulverized toner particles having a volume average particle size of 4.0 μm or less were removed. First toner particles obtained after classification had a volume average particle size of 5.54 μm.

[Spheronizing Step]

By using an impact-type spheronizing device (trade name: FACULTY F-600) manufactured by Hosokawa Micron Corporation, the excessively-pulverized toner particles removed by the classifying step were treated with a spheronization process under a condition as described hereinbelow. An input amount of the excessively-pulverized toner particles at one time was determined to be 1.5 kg, a rotation speed of a classifying rotor was determined to be 5,000 rpm to remove fine particles, a rotation speed of a dispersing rotor was determined to be 5,800 rpm, and the spheronization process continued for 120 seconds. A length of time for the spheronization process refers to a time period extending over from a time point at which the excessively-pulverized toner particles are input to a time point at which a discharge valve of second toner particles is opened. A clearance d1 between the dispersing rotor and a liner was set to be 2.0 mm, and a clearance d2 between an end of a partition member and an inner wall surface of the treatment tank was set to be 40 mm. The excessively-pulverized toner particles were treated with the spheronization process as described above, and second toner particles having a volume average particle size of 3.81 μm were obtained.

[Mixing Step]

In the mixing step, 100 parts by weight of the first tone particles obtained by the classifying step were mixed with 3 parts by weight of the second toner particles obtained by the spheronizing step. A toner of Example 1 was thus obtained.

Example 2

In the spheronizing step, excessively-pulverized toner particles obtained in the same manner as used in Example 1 were treated with a spheronization process under a condition hereinbelow by using a hot-air-type spheronizing device (trade name: METEO RAINBOW, manufactured by Nippon Pneumatic MFG. Co., Ltd.) As the condition of the spheronization process, an input amount of the excessively-pulverized toner particles was set to be 3.0 kg per hour, a supply amount of hot air to be 900 L per minute, a temperature of the hot air to be 190° C., a supply pressure of cooled air to be 0.15 MPa, and a supply amount of air from a secondary air injection nozzle was set to be 230 L per minute. Further, a distance L between a cooled air inlet and a collision member was set to be 2.0 cm. Under the above condition, the excessively-pulverized toner particles were treated with the spheronization process and second toner particles having a volume average particle size of 3.81 μm were thus obtained.

Next, in the mixing step, 100 parts by weight of first toner particles obtained in the same manner as in Example 1 were mixed with 5 parts by weight of the second toner particles obtained by the spheronization process of Example 2. A toner of Example 2 was thus obtained.

Example 3

A toner of Example 3 was obtained in the same manner as in Example 1 except that the spheronization process continued for 240 seconds in the spheronizing step and 12 parts by weight of the second toner particles were mixed in the mixing step.

Example 4

A toner of Example 4 was obtained in the same manner as in Example 2 except that 3 parts by weight of the second toner particles were mixed in the mixing step.

Example 5

A toner of Example 5 was obtained in the same manner as in Example 1 except that the spheronization process continued for 180 seconds in the spheronizing step and 19 parts by weight of the second toner particles were mixed in the mixing step.

Example 6

A toner of Example 6 was obtained in the same manner as in Example 1 except that the spheronization process continued for 150 seconds in the spheronizing step and 6 parts by weight of the second toner particles were mixed in the mixing step.

Example 7

A toner of Example 7 was obtained in the same manner as in Example 2 except that 0.5 part by weight of silica microparticles (trade name: R972; manufactured by Nippon Aerosil Co., Ltd.) were externally added as an external additive to the excessively-pulverized toner particles before the spheronizing step was started, that a temperature of the hot air in the spheronizing step was set to be 230° C., and that 7 parts by weight of the second toner particles were mixed in the mixing step.

Example 8

A toner of Example 8 was obtained in the same manner as Example 2 except that a temperature of the hot air was set to be 205° C. in the spheronizing step and 3 parts by weight of the second toner particles were mixed in the mixing step.

Example 9

A toner of Example 9 was obtained in the same manner as Example 1 except that the spheronization process continued for 120 seconds in the spheronizing step and 3 parts by weight of the second toner particles were mixed in the mixing step.

Comparative Example 1

A toner of Comparative Example 1 was obtained in the same manner as Example 1 except that the spheronization process continued for 20 seconds in the spheronizing step and 2 parts by weight of the second toner particles were mixed in the mixing step.

Comparative Example 2

A toner of Comparative Example 2 was obtained in the same manner as Example 1 except that the spheronization process continued for 10 seconds in the spheronizing step and 21 parts by weight of the second toner particles were mixed in the mixing step.

Comparative Example 3

A toner of Comparative Example 3 was obtained in the same manner as Example 1 except that the spheronization process continued for 10 seconds in the spheronizing step and 10 parts by weight of the second toner particles were mixed in the mixing step.

Comparative Example 4

A toner of Comparative Example 4 was obtained in the same manner as Example 2 except that 0.5 part by weight of silica microparticles (trade name: R972; manufactured by Nippon Aerosil Co., Ltd.) were externally added as an external additive on the basis of 100 parts by weight of the excessively-pulverized toner particles before the spheronizing step was started, that a temperature of the hot air was set to be 240° C. in the spheronizing steps and that 7 parts by weight of the second toner particles were mixed in the mixing step.

Comparative Example 5

A toner of Comparative Example 5 was obtained in the same manner as Example 2 except that a temperature of the hot air in the spheronizing step was set to be 120° C. and 8 parts by weight of the second toner particles were mixed in the mixing step.

Comparative Example 6

A toner of Comparative Example 6 was obtained in the same manner as Example 2 except that a temperature of the hot air in the spheronizing step was set to be 240° C. and 6 parts by weight of the second toner particles were mixed in the mixing step.

Comparative Example 7

A toner of Comparative Example 7 was obtained in the same manner as Example 2 except that a temperature of the hot air in the spheronizing step was set to be 220° C. and 7 parts by weight of the second toner particles were mixed in the mixing step.

Comparative Example 8

A toner of Comparative Example 8 was obtained in the same manner as Example 2 except that a temperature of the hot air in the spheronizing step was set to be 150° C. and 2 parts by weight of the second toner particles were mixed in the mixing step.

Comparative Example 9

A toner of Comparative Example 9 was obtained in the same manner as Example 1 except that the spheronization process continued for 15 seconds in the spheronizing step and 2 parts by weight of the second toner particles were mixed in the mixing step.

Comparative Example 10

A toner of Comparative Example 10 was obtained in the same manner as Example 1 except that the spheronization process continued for 20 seconds in the spheronizing step and 2 parts by weight of the second toner particles were mixed in the mixing step.

Comparative Example 11

A toner of Comparative Example 11 was obtained in the same manner as Example 1 except that the spheronization process continued for 25 seconds in the spheronizing step and 23 parts by weight of the second toner particles were mixed in the mixing step.

Comparative Example 12

A toner of Comparative Example 12 was obtained in the same manner as Example 1 except that the spheronization process continued for 25 seconds in the spheronizing step and 23 parts by weight of the second toner particles were mixed in the mixing step.

Comparative Example 13

A toner of Comparative Example 13 was obtained in the same manner as Example 1 except that the spheronization process continued for 25 seconds in the spheronizing step and 22 parts by weight of the second toner particles were mixed in the mixing step.

Comparative Example 14

A toner of Comparative Example 14 was obtained in the same manner as Example 1 except that the spheronization process continued for 25 seconds in the spheronizing step and 2 parts by weight of the second toner particles were mixed in the mixing step.

Table 1 shows time of the spheronization processes and volume average particle sizes of the first and the second toner particles used in Examples 1, 3, 5, 6, 9 and Comparative Examples 1-3 and 9-14 in which the spheronization processes were respectively performed by using the impact-type spheronizing device in the spheronizing step. Table 1 also shows contents of the second toner particles, volume average particle sizes, average degrees of circularity and particle size distributions of the toners of Examples 1, 3, 5, 6, 9 and Comparative Examples 1-3 and 9-14. Further, Table 1 shows average degrees of circularity and contents of small-size particles contained in the just-described toners, and contents of toner particles (hereinafter, referred to as "amorphous particles") which are contained in the just-described small-size particles and have an average degree of circularity of 0.850 or less.

TABLE 1

| | | | | Toner | | | | | | | | |
|---|---|---|---|---|---|---|---|---|---|---|---|---|
| | | | | | | | | | | Small-size particles | | |
| | Processing time (Second) | First toner particles $D_{50V}$ (μm) | Second toner particles $D_{50V}$ (μm) | Content of second toner particles (Part by weight) | $D_{50V}$ (μm) | Average degree of circularity | Particle size distribution $D_{50P}$ | $D_{84P}$ | $D_{50P}/D_{84P}$ | Average degree of circularity | Content (% by number) | Content of amorphous particles (% by number) |
| Ex. 1 | 120 | 5.54 | 3.81 | 3 | 5.51 | 0.956 | 4.76 | 3.31 | 1.436 | 0.945 | 29 | 7 |
| Ex. 3 | 240 | 5.63 | 3.80 | 12 | 5.44 | 0.961 | 4.33 | 2.64 | 1.640 | 0.951 | 43 | 7 |
| Ex. 5 | 180 | 5.61 | 4.30 | 19 | 5.40 | 0.962 | 4.31 | 2.63 | 1.638 | 0.956 | 30 | 8 |
| Ex. 6 | 150 | 5.52 | 3.82 | 6 | 5.49 | 0.954 | 4.81 | 3.26 | 1.474 | 0.946 | 28 | 8 |
| Ex. 9 | 120 | 7.06 | 3.91 | 3 | 7.1 | 0.959 | 6.50 | 4.50 | 1.443 | 0.952 | 8 | 3 |
| Comp. Ex. 1 | 20 | 5.58 | 3.81 | 2 | 5.7 | 0.957 | 4.91 | 3.46 | 1.420 | 0.946 | 21 | 9 |
| Comp. Ex. 2 | 10 | 5.48 | 3.77 | 21 | 5.38 | 0.956 | 4.22 | 2.56 | 1.651 | 0.948 | 49 | 3 |
| Comp. Ex. 3 | 10 | 5.51 | 3.78 | 10 | 5.42 | 0.955 | 4.61 | 3.05 | 1.510 | 0.939 | 28 | 9 |
| Comp. Ex. 9 | 15 | 5.52 | 3.85 | 2 | 5.74 | 0.955 | 5.01 | 3.53 | 1.419 | 0.938 | 26 | 12 |
| Comp. Ex. 10 | 20 | 5.53 | 3.88 | 2 | 5.71 | 0.957 | 5.02 | 3.54 | 1.419 | 0.946 | 19 | 6 |
| Comp. Ex. 11 | 25 | 5.62 | 3.74 | 23 | 5.39 | 0.956 | 4.21 | 2.55 | 1.652 | 0.948 | 51 | 8 |
| Comp. Ex. 12 | 25 | 5.51 | 3.72 | 23 | 5.32 | 0.954 | 4.23 | 2.55 | 1.657 | 0.939 | 51 | 11 |
| Comp. Ex. 13 | 25 | 5.59 | 3.80 | 22 | 5.31 | 0.955 | 4.10 | 2.48 | 1.652 | 0.940 | 49 | 11 |
| Comp. Ex. 14 | 25 | 5.54 | 3.69 | 2 | 5.72 | 0.954 | 4.88 | 3.43 | 1.421 | 0.939 | 22 | 9 |

Table 2 shows temperatures of hot air, volume average particle sizes of the first and the second toner particles, and existence or nonexistence of silica microparticles in Examples 2, 4, 7, 8 and Comparative Examples 4-8 in which the spheronization processes were respectively performed by using the hot-air-type spheronizing device in the spheronizing step. Table 2 also shows contents of the second toner particles, volume average particle sizes, average degrees of circularity, and particle size distributions of the toners of Examples 2, 4, 7, 8 and Comparative Examples 4-8. Further, Table 2 shows average degrees of circularity of small-size particles contained in the just-described toners, contents of the small-size particles contained in the respective toners, and contents of the amorphous particles contained in the small-size particles.

TABLE 2

| | Temperature of hot air (° C.) | First toner particles $D_{50V}$ (μm) | Second toner particles $D_{50V}$ (μm) | External additive | Toner: Content of second toner particles (Part by weight) | Toner: $D_{50V}$ (μm) | Toner: Average degree of circularity | Toner: Particle size distribution $D_{50P}$ | Toner: Particle size distribution $D_{84P}$ | Toner: Particle size distribution $D_{50P}/D_{84P}$ | Toner: Small-size particles: Average degree of circularity | Toner: Small-size particles: Content (% by number) | Toner: Small-size particles: Content of amorphous particles (% by number) |
|---|---|---|---|---|---|---|---|---|---|---|---|---|---|
| Ex. 2 | 190 | 5.53 | 3.81 | Not Used | 5 | 5.50 | 0.957 | 4.71 | 3.20 | 1.474 | 0.946 | 30 | 8 |
| Ex. 4 | 190 | 5.52 | 3.30 | Not used | 3 | 5.50 | 0.956 | 4.71 | 3.29 | 1.431 | 0.950 | 27 | 8 |
| Ex. 7 | 230 | 5.53 | 3.78 | Used | 7 | 5.51 | 0.976 | 4.79 | 3.24 | 1.478 | 0.960 | 27 | 8 |
| Ex. 8 | 205 | 4.89 | 3.78 | Not used | 3 | 4.80 | 0.963 | 3.90 | 2.38 | 1.639 | 0.951 | 60 | 7 |
| Comp. Ex. 4 | 240 | 5.54 | 3.82 | Used | 7 | 5.43 | 0.961 | 4.58 | 3.01 | 1.521 | 0.961 | 28 | 7 |
| Comp. Ex. 5 | 120 | 5.53 | 3.71 | Not used | 8 | 5.49 | 0.957 | 4.82 | 3.24 | 1.489 | 0.941 | 28 | 12 |
| Comp. Ex. 6 | 240 | 5.63 | 3.79 | Not used | 6 | 5.48 | 0.977 | 4.77 | 3.30 | 1.445 | 0.961 | 20 | 9 |
| Comp. Ex. 7 | 220 | 5.52 | 3.80 | Not used | 7 | 5.46 | 0.955 | 4.79 | 3.31 | 1.448 | 0.939 | 22 | 14 |
| Comp. Ex. 8 | 150 | 5.61 | 3.91 | Not used | 2 | 5.72 | 0.958 | 4.91 | 3.46 | 1.420 | 0.939 | 28 | 8 |

[Manufacture of Two-Component Developer]

With 5 parts by weight of the respective toners of Examples 1-9 and Comparative Examples 1-14, 95 parts by weight of ferrite core carrier having a volume average particle size of 45 μm was mixed as a carrier for 20 minutes by a V-shaped mixer V-5 (trade name) manufactured by Kabushiki Kaisha Tokuju Kosakusho. Two-component developers each having a toner density of 5% by weight were thus manufactured.

[Evaluation]

By using methods described below, evaluations were made on void and resolution of images formed by using the two-component developers respectively containing the toners of Examples 1-9 and Comparative Examples 1-14, as well as transfer efficiency, cleaning property and charge stability in forming the images. The results thus obtained are shown in Table 3.

[Void]

The two-component developers respectively containing the toners of Examples 1-9 and Comparative Examples 1-14 were filled to a commercially-available copier MX-2300G (trade name) manufactured by Sharp Corporation and a fixing amount was adjusted to be 0.4 mg/cm$^2$, so as to form a 3×5-isolated-dot image. The 3×5-isolated-dot image refers to an image so formed that at 600 dpi (dot per inch), adjacent dot parts among plural dot parts each having a length of three dots and a width of three dots are separated from each other by a distance of five dots. The formed image was enlarged by 100-fold using a microscope manufactured by Keyence Corporation and displayed on a monitor. Out of 70 pieces of 3×5 isolated-dot portions, number of void-occurring portions was determined. Note that evaluations "Excellent", "Good", "Not bad", and "Poor" are used to show results of evaluation on the void. Evaluation criteria are as follows.

Excellent: The number of the void-occurring portions remains in a range of from 0 to 3.

Good: The number of the void-occurring portions remains in a range of from 4 to 6.

Not bad: The number of the void-occurring portions remains in a range of from 7 to 10.

Poor: The number of the void-occurring portions is eleven or more.

[Resolution]

A manuscript where had formed an original image of 100 μm-wide thin line was copied by the above copier under a condition that a halftone image having a image density of 0.3 and a diameter of 5 mm can be copied so that the image density remains in 0.3 or higher and 0.5 or lower. The copy image thus obtained was used as a sample for measurement. A width of thin line formed in the sample for measurement was determined by an indicator, on the basis of a monitor image which was obtained by enlarging by 100-fold the sample for measurement using a particle analyzer (trade name: LUZEX 450; manufactured by Nireco Corporation). The image density refers to an optical reflection density measured by a reflection densitometer (trade name: RD-918; manufactured by Macbeth Corporation). The thin line has irregularities and a width of the thin line thus changes depending on measurement positions. Therefore, an average value of line widths measured at plural measurement positions was calculated and determined to be a line width of the sample for measurement. A reproducibility value of the thin line was obtained by centupling a value which was calculated by dividing the line width of the sample for measurement by the line width 100 μm of the manuscript. When the reproducibility value of the thin line is closer to 100, the reproducibility of the thin line is better and the resolution is higher. Note that evaluations "Excellent", "Good", "Not bad", and "Poor" are used to show results of evaluation on the resolution. Evaluation criteria are as follows.

Excellent: The reproducibility value of the thin line is 100 or more and less than 105.

Good: The reproducibility value of the thin line is 105 or more and less than 115.

Not bad: The reproducibility value of the thin line is 115 or more and less than 125.

Poor: The reproducibility value of the thin line is 125 or more.

[Transfer Efficiency]

Transfer efficiency refers to a proportion of the toner transferred from the surface of the photoreceptor drum to the intermediary transfer belt in one primary transfer. The transfer efficiency was calculated by assuming an amount of toner existent on the photoreceptor drum prior to the transfer to be 100%. The amount of the toner existent on the photoreceptor drum prior to the transfer was obtained by measuring an amount of the toner suctioned by a charge quantity measuring device (trade name: 210HS-2A; manufactured by Trek Japan K.K.) In addition, an amount of the toner transferred onto the intermediary transfer belt was also obtained in the same manner. Note that evaluations "Excellent", "Good", "Not bad", and "Poor" are used to show results of evaluation on the transfer efficiency. Evaluation criteria are as follows.

Excellent: The transfer efficiency is 95% or more.

Good: The transfer efficiency is 90% or more and less than 95%.

Not bad: The transfer efficiency is 85% or more and less than 90%.

Poor: The transfer efficiency is less than 85%.

[Cleaning Property]

A pressure of a cleaning blade was adjusted so that an initial linear pressure attained to 25 gf/cm ($2.45\times10^{-1}$ N/cm), wherein the pressure of the cleaning blade refers to a pressure occurring when the cleaning blade of a cleaning unit disposed in the commercially-available copier (trade name: MX-2300G; manufactured by Sharp Corporation) makes abutment-contact with the photoreceptor drum. This copier was filled with the two-component developers respectively containing the toners of Examples 1-9 and Comparative Examples 1-14. By using such a copier as just described, 100,000 copies of a character text chart created by Sharp Corporation were made at 25° C. and at 50% relative humidity, so as to determine the cleaning property.

By confirming a formed image by eye before the image formed (an Initial stage), after 5,000 (5K) copies were made, and after 10,000 (10K) copies were made, a test was conducted on definition of a boundary located between an image area and a non-image area, as well as on existence or nonexistence of a black streak formed by leakage of toner in a rotation direction of the photoreceptor drum. Further, an amount of fog Wk of the formed image was determined by a later-described measuring device. The cleaning property was thus evaluated. R reflection density was measured by using a color measuring system Z-Σ90 manufactured by Nippon Denshoku Industries Co., Ltd. and the amount of fog Wk of the formed image was determined as follows. First of all, a reflection average density Wr of recording paper was measured prior to image formation. Then, after an image was formed by a recording portion, reflection densities were measured at different white parts of the recording paper. A value was determined according to the following formula (5), on the basis of the above-described Wr and a reflection density Ws of a part greatest in fog amount, namely a white part highest in density. The value thus determined was defined as the amount of fog Wk (%). Note that evaluations "Excellent", "Good", "Not bad", and "Poor" are used to show results of evaluation on the cleaning property. Evaluation criteria are as follows.

$$Wk=100\times((Ws-Wr)/Wr) \quad (5)$$

Excellent: Very favorable. The definition is good and no black streak occurs. And the amount of fog Wk is less than 3%.

Good: Favorable. The definition is good and no black streak occurs. And the amount of fog Wk is 3% or more and less than 5%.

Not bad: No problem in practical use. The definition basically does not induce a problem in practical use and the break streaks is 2.0 mm or less in length and 5 pieces or less in number. And the amount of fog Wk is 5% or more and less than 10%.

Poor: Unusable in practice. There exists a problem in definition in practical use. The black streaks are at least either greater than 2.0 mm in length or 6 pieces or more in number. And the amount of fog Wk is 10% or more.

[Charge Stability]

With 5 parts by weight of the respective toners of Examples 1-9 and Comparative Examples 1-14, 95 parts by weight of ferrite carrier having a volume average particle size of 45 μm was respectively mixed and stirred for 30 minutes at 25° C. and 50% relative humidity using a desk ball mill manufactured by Tokyo Class Kikai Kabushiki Kaisha. And then, charge amounts of the toners in the initial stage were measured. Further, using the two-component developers respectively containing the toners of Examples 1-9 and Comparative Examples 1-14, a text chart having a print ratio of 6% was copied to make 10,000 copies by a commercially-available copier AR-C150 (trade name) manufactured by Sharp Corporation. And then, charge amounts of the toners were measured again.

The charge amounts of the toners were measured as described below by using a charge amount measuring device 210HS-2A (trade name) manufactured by TREK Japan K.K. A mixture of ferrite particles and toner collected from the ball mill was put into a metal container having a 500-mesh electrically-conductive screen at its bottom. Only the toner was thereafter suctioned by a suction machine at a suction pressure of 250 mmHg. And then, the charge amount of the toner was calculated on the basis of a weight difference between the before-suction mixture and the after-suction mixture and a potential difference between electrode plates of a capacitor connected to the container. Assuming the initial charge amount of toner thus calculated to be $Q_{ini}$ (μC/g) and the charge amount of toner measured after 10,000 (10K) copies had been made to be Q (μC/g), a decrease rate in charge amount of the toner was determined according to the following formula (6).

$$\text{Decrease rate in charge amount (\%)}=100\times|(Q-Q_{ini})/Q_{ini}| \quad (6)$$

The lower the decrease rate in the charge amount, the better the charge stability. Note that evaluations "Excellent", "Good", "Not bad", and "Poor" are used to show results of evaluation on the charge stability. Evaluation criteria are as follows.

Excellent: The decrease rate in the charge amount is less than 6%.

Good: The decrease rate in the charge amount is 6% or more and less than 10%.

Not bad: The decrease rate in the charge amount is 10% or more and less than 15%.

Poor: The decrease rate in the charge amount is 15% or more.

[Comprehensive Evaluation]

Note that evaluations "Excellent", "Good", "Not bad", and "Poor" are used to show results of the comprehensive evaluation. Evaluation criteria are as follows.

Excellent: Very favorable. There is neither the evaluation "Not bad" nor the evaluation "Poor" in the results of evaluation on void, resolution, transfer efficiency, cleaning property, and charge stability.

Good: Favorable. In the results of evaluation on void, resolution, transfer efficiency, cleaning property, and charge stability, there is no evaluation "Poor" and number of evaluation "Not bad" remains 1 or more and 3 or less.

Not bad: No problem in practical use. In the results of evaluation on void, resolution, transfer efficiency, cleaning property, and charge stability, there is no evaluation "Poor", but number of evaluation "Not bad" is 4 or more.

Poor: Unusable in practice. There is the evaluation "Poor" in the results of evaluation on void, resolution, transfer efficiency, cleaning property, and charge stability.

results on void, resolution, transfer efficiency, cleaning property, and charge stability, compared with the two-component developers using the toners of Examples 6-9.

The invention may be embodied in other specific forms without departing from the spirit or essential features thereof.

TABLE 3

| | Image evaluation | | Transfer efficiency | | Cleaning property | | | Charge stability | | | | |
|---|---|---|---|---|---|---|---|---|---|---|---|---|
| | Void | Resolution | Measurement value (%) | Evaluation | Initial | After 5K copies | After 10K copies | Initial (μC/g) | After 10K copies (μC/g) | Decrease rate (%) | Evaluation | Comprehensive evaluation |
| Ex. 1 | Good | Good | 91 | Good | Excellent | Excellent | Excellent | −19.2 | −18.0 | 6 | Good | Excellent |
| Ex. 2 | Excellent | Excellent | 98 | Excellent | Excellent | Excellent | Excellent | −19.2 | −18.6 | 3 | Excellent | Excellent |
| Ex. 3 | Excellent | Excellent | 98 | Excellent | Excellent | Good | Good | −18.7 | −17.6 | 6 | Good | Excellent |
| Ex. 4 | Good | Good | 96 | Excellent | Excellent | Good | Good | −19.2 | −18.4 | 4 | Excellent | Excellent |
| Ex. 5 | Good | Excellent | 96 | Excellent | Excellent | Good | Good | −18.9 | −17.6 | 7 | Good | Excellent |
| Ex. 6 | Not bad | Good | 89 | Not bad | Excellent | Excellent | Excellent | −17.6 | −17.1 | 3 | Excellent | Good |
| Ex. 7 | Excellent | Good | 97 | Excellent | Excellent | Not bad | Not bad | −18.5 | −17.8 | 4 | Excellent | Good |
| Ex. 8 | Good | Excellent | 99 | Excellent | Excellent | Good | Not bad | −18.9 | −18.0 | 5 | Excellent | Good |
| Ex. 9 | Good | Not bad | 98 | Excellent | Excellent | Good | Good | −18.9 | −17.6 | 7 | Good | Good |
| Comp. Ex. 1 | Good | Poor | 98 | Excellent | Excellent | Good | Good | −18.9 | −17.0 | 10 | Not bad | Poor |
| Comp. Ex. 2 | Good | Excellent | 85 | Not bad | Not bad | Not bad | Poor | −17.1 | −15.9 | 7 | Good | Poor |
| Comp. Ex. 3 | Good | Good | 83 | Poor | Excellent | Good | Good | −18.9 | −17.0 | 10 | Not bad | Poor |
| Comp. Ex. 4 | Good | Good | 98 | Excellent | Excellent | Good | Poor | −21.3 | −18.2 | 15 | Poor | poor |
| Comp. Ex. 5 | Good | Good | 80 | Poor | Excellent | Good | Good | −18.2 | −16.5 | 9 | Good | Poor |
| Comp. Ex. 6 | Excellent | Not bad | 85 | Not bad | Excellent | Not bad | Poor | −18.9 | −17.4 | 8 | Good | Poor |
| Comp. Ex. 7 | Not bad | Not bad | 78 | Poor | Excellent | Good | Good | −19.2 | −17.0 | 11 | Not bad | Poor |
| Comp. Ex. 8 | Not bad | Poor | 86 | Not bad | Excellent | Excellent | Excellent | −19.5 | −17.0 | 13 | Not bad | poor |
| Comp. Ex. 9 | Poor | Poor | 80 | Poor | Excellent | Excellent | Excellent | −18.3 | −16.8 | 8 | Good | Poor |
| Comp. Ex. 10 | Not bad | Poor | 97 | Excellent | Excellent | Good | Good | −22.1 | −18.1 | 18 | Poor | poor |
| Comp. Ex. 11 | Good | Excellent | 85 | Not bad | Not bad | Not bad | Poor | −18.0 | −15.0 | 17 | Poor | poor |
| Comp. Ex. 12 | Poor | Not bad | 80 | Poor | Not bad | Poor | Poor | −17.1 | −14.8 | 13 | Not bad | Poor |
| Comp. Ex. 13 | Good | Excellent | 83 | Poor | Not bad | Not bad | poor | −19.1 | −15.1 | 21 | Poor | Poor |
| Comp. Ex. 14 | Not bad | Poor | 86 | Not bad | Excellent | Good | Good | −18.8 | −17.2 | 9 | Good | Poor |

As described below, the results shown in Table 3 make it clear that the two-component developers containing the toners of Examples 1-9 are superior to the two-component developers containing the toners of Comparative Examples 1-14.

In the two-component developers containing the toners of Examples 1-9, a ratio of $D_{50P}$ to $D_{84P}$ is 1.43 or more and 1.64 or less, an average degree of circularity of the small-size particles is 0.940 or more and 0.960 or less, and a content of the amorphous particles contained in the small-size particles is 10% by number or less. Therefore, compared with the two-component developers containing the toners of Comparative Examples 1-14, the two-component developers containing the toners of Examples 1-9 exhibited better evaluation results on void, resolution, transfer efficiency, cleaning property, and charge stability.

In the toners of Examples 1-5, a content of the small-size particles is from 20% by number to 50% by number on the basis of the entire toner particles, and an average degree of circularity of the entire toner particles remains 0.955 or more and 0.975 or less. Further, the two-component developers using the toners of Examples 1-5 exhibited better evaluation The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A toner comprising a mixture of first toner particles and second toner particles, the first toner particles being obtained by removing excessively-pulverized toner particles from a pulverized material at least containing a binder resin and a colorant through classification, the volume average particle size of the first toner particles being 4 μm or more and 8 μm or less, the second toner particles containing small-size particles having a volume average particle size of 1 μm or more and 4 μm or less and being obtained by spheronizing the excessively-pulverized toner particles having a smaller volume average particle size than that of the first toner particles, all of the first and second toner particle sizes $D_{50p}$ and $D_{84P}$ satisfying the following formula (1):

$$1.43 \leqq D_{50p}/D_{84p} \leqq 1.64 \quad (1)$$

wherein $D_{50p}$ and $D_{84p}$ respectively representing particle sizes at 50% and 84% of cumulative number counted from a large-size side in a cumulative number distribution, an average degree of circularity of the small-size particles contained in the second toner particles being 0.940 or more and 0.960 or less, and among the small-size particles contained in the second toner particles, a content of amorphous particles having an average degree of circularity of 0.850 or less being 10% by number or less.

2. The toner of claim 1, wherein the particle sizes $D_{50p}$ and $D_{84p}$ satisfy the following formula (2):

$$1.46 \leqq D_{50p}/D_{84p} \leqq 1.64 \quad (2)$$

3. The toner of claim 1, wherein the small-size particles contained in the second toner particles are contained in a ratio of 20% by number or more and 50% by number or less on the basis of the entire toner particles.

4. The toner of claim 1, wherein an average degree of circularity of the entire toner particles is 0.955 or more and 0.975 or less.

5. A method of manufacturing the toner of claim 1, comprising:

a premixing step of mixing a toner raw material at least containing a binder resin and colorant so as to prepare a toner raw material mixture;

a melt-kneading step of melt-kneading the toner raw material mixture so as to prepare a resin composition;

a pulverizing step of pulverizing the resin composition so as to prepare a pulverized material;

a classifying step of classifying the pulverized material into first toner particles and excessively-pulverized toner particles having a smaller volume average particle size than that of the first toner particles;

a spheronizing step of performing a spheronization process on the excessively-pulverized toner particles so as to prepare second toner particles; and a mixing step of mixing the first toner particles and the second toner particles.

6. The method of claim 5, wherein in the mixing step, the second toner particles are mixed with the first toner particles in a ratio of 3 parts by weight or more and 20 parts by weight or less on the basis of 100 parts by weight of the first toner particles.

7. The method of claim 5, wherein in the spheronizing step, the second toner particles are manufactured by performing a spheronization process on the excessively-pulverized toner particles with the aid of mechanical impact or hot air.

8. A two-component developer containing the toner of claim 1 and a carrier.

* * * * *